US010452012B2

(12) United States Patent
Usui et al.

(10) Patent No.: US 10,452,012 B2
(45) Date of Patent: Oct. 22, 2019

(54) CYLINDRICAL FIXING MEMBER, FIXING DEVICE AND IMAGE FORMING APPARATUS

(71) Applicant: CANON KABUSHIKI KAISHA, Tokyo (JP)

(72) Inventors: Masatake Usui, Susono (JP); Takaaki Tsuruya, Mishima (JP); Yasuo Yoda, Numazu (JP); Yasunari Kobaru, Susono (JP); Akira Kato, Mishima (JP); Hiroki Eguchi, Yokohama (JP); Michio Uchida, Mishima (JP); Tetsuya Sano, Mishima (JP); Atsuyoshi Abe, Suntou-gun (JP); Aoji Isono, Naka-gun (JP); Minoru Hayasaki, Mishima (JP); Hiroshi Mano, Numazu (JP); Yuki Nishizawa, Yokohama (JP); Akira Kuroda, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/070,012

(22) PCT Filed: Mar. 15, 2017

(86) PCT No.: PCT/JP2017/011558
§ 371 (c)(1),
(2) Date: Jul. 13, 2018

(87) PCT Pub. No.: WO2017/159882
PCT Pub. Date: Sep. 21, 2017

(65) Prior Publication Data

US 2019/0018350 A1 Jan. 17, 2019

(30) Foreign Application Priority Data

Mar. 15, 2016 (JP) ..... 2016-050769
Sep. 23, 2016 (JP) ..... 2016-185310
Feb. 14, 2017 (JP) ..... 2017-024740

(51) Int. Cl.
*G03G 15/20* (2006.01)
*G03G 15/00* (2006.01)
(Continued)

(52) U.S. Cl.
CPC ..... *G03G 15/206* (2013.01); *G03G 15/2053* (2013.01); *G03G 15/80* (2013.01); *H05B 1/0241* (2013.01); *H05B 6/145* (2013.01)

(58) Field of Classification Search
CPC ..... G03G 15/2053; G03G 15/2057; G03G 15/206; G03G 15/2064; G03G 15/80
(Continued)

(56) References Cited

U.S. PATENT DOCUMENTS 6,661,992 B2 * 12/2003 Lee ..... G03G 15/2053 219/216
7,266,337 B2 9/2007 Nakamura et al.
(Continued)

FOREIGN PATENT DOCUMENTS

EP 1 469 356 A1 10/2004
JP 2002-222689 A 8/2002
(Continued)

*Primary Examiner* — Hoan H Tran
(74) *Attorney, Agent, or Firm* — Venable LLP

(57) ABSTRACT

A cylindrical fixing member for use with a fixing device includes a heat generating layer and an electrode layer contacting the heat generating layer. The electrode layer is smaller in volume resistance value than the heat generating layer. The electrode layer is formed in a helical shape so that a helical axis thereof extends in a direction along a generatrix direction of the fixing member. One end and the other end of the electrode layer are electrically open.

16 Claims, 22 Drawing Sheets

(51) Int. Cl.
*H05B 6/14* (2006.01)
*H05B 1/02* (2006.01)

(58) Field of Classification Search
USPC ..... 399/107, 110, 122, 320, 328, 329, 330, 399/333, 334
See application file for complete search history.

(56) References Cited

U.S. PATENT DOCUMENTS

| | | | | |
|---|---|---|---|---|
| 9,261,834 | B2 * | 2/2016 | Yonekubo ..... | G03G 15/2053 |
| 9,377,733 | B2 | 6/2016 | Nishizawa et al. | |
| 9,405,249 | B2 | 8/2016 | Hirai et al. | |
| 9,442,440 | B2 | 9/2016 | Hashiguchi et al. | |
| 9,547,264 | B2 | 1/2017 | Kurata et al. | |
| 9,563,159 | B2 | 2/2017 | Jota et al. | |
| 9,618,889 | B2 | 4/2017 | Nishizawa et al. | |
| 9,983,525 | B2 | 5/2018 | Eguchi et al. | |
| 10,012,935 | B2 | 7/2018 | Nishizawa et al. | |
| 2002/0125244 | A1 | 9/2002 | Yokozeki et al. | |
| 2003/0000943 | A1 | 1/2003 | Yokozeki | |
| 2009/0028616 | A1 | 1/2009 | Nakamura et al. | |

FOREIGN PATENT DOCUMENTS

| | | | |
|---|---|---|---|
| JP | 2006-216476 | A | 8/2006 |
| JP | 2014-26267 | A | 2/2014 |
| JP | 2015-118233 | A | 6/2015 |

* cited by examiner (a)

(b)

(c)

CYLINDRICAL FIXING MEMBER, FIXING DEVICE AND IMAGE FORMING APPARATUS

TECHNICAL FIELD

The present invention relates to a circumference (rotatable heating member) suitable as a cylindrical film of a fixing device of an electromagnetic induction heating type, mounted in an image forming apparatus, such as an electrophotographic copying machine or an electrophotographic printer, and relates to the fixing device and the image forming apparatus which include the cylindrical fixing member.

BACKGROUND ART

In the electrophotographic copying machine or printer, a fixing device for fixing a toner image on a recording material by heating the recording material while feeding the recording material on which the toner image which has not been fixed is carried is mounted. As this fixing device, a fixing device of an electromagnetic induction heating type has been known. The fixing device of this type has advantages such that a temperature rise of the cylindrical film (rotatable heating member) for heating the recording material is quick and that also electric power consumption is low.

In Japanese Laid-Open Patent Application (JP-A) 2014-26267, a fixing device of an electromagnetic induction heating type in which an exciting coil and a magnetic core are provided inside of a cylindrical rotatable heating member and an alternating magnetic field is generated with respect to an axial direction of the rotatable heating member, and then the rotatable heating member is heated by a circumferential current generating around an electroconductive layer of the rotatable heating member with respect to a circumferential direction has been disclosed. In JP-A 2014-26267, as a material of the electroconductive layer as a heat generating layer of the rotatable heating member, metal is employed. The metal is low in volume resistivity, and therefore even at a voltage value of a commercial power source level, the circumferential current sufficiently flows, so that also temperature rise is quick.

On the other hand, when a resin film of polyimide or the like can be employed as the rotatable heating member, it is desirable from viewpoints of a cost and flexibility. However, even when electroconductivity is imparted to the resin film by adding an electroconductive agent such as carbon black, there was a limit that the volume resistivity of the resin film is lowered to about $1\times10^{-4}$ Ωm. For that reason, at the voltage of the commercial power source level, the circumferential current merely flows a little, and therefore a temperature rising speed is slow, so that there is a problem that it is difficult to employ the resin film as the rotatable heating member.

SUMMARY OF THE INVENTION

A principal object of the present invention is to provide a cylindrical fixing member excellent in temperature rising speed, a fixing device including the cylindrical fixing member, and an image forming apparatus including the cylindrical fixing member.

According to as aspect of the present invention, there is provided a cylindrical fixing member for use with a fixing device, comprising: a heat generating layer; and an electrode layer contacting the heat generating layer, wherein the electrode layer is smaller in volume resistance value than the heat generating layer, wherein the electrode layer is formed in a helical shape so that a helical axis thereof extends in a direction along a generatrix direction of the fixing member, and wherein one end and the other end of the electrode layer are electrically open.

According to another aspect of the present invention, there is provided a fixing device comprising: a cylindrical fixing member, wherein the cylindrical fixing member includes, a heat generating layer and an electrode layer contacting the heat generating layer, wherein the electrode layer is smaller in volume resistance value than the heat generating layer, wherein the electrode layer is formed in a helical shape so that a helical axis thereof extends in a direction along a generatrix direction of the fixing member, and wherein one end and the other end of the electrode layer are electrically open; a coil provided at a hollow portion of the cylindrical fixing member, wherein the coil includes a helical-stepped portion having a helical axis extending in a direction along the generatrix direction of the cylindrical fixing member, and a magnetic field is formed for subjecting the heat generating layer to electromagnetic induction heating by causing an alternating current to flow through the coil; and a magnetic core provided inside the helical-stepped portion of the coil and extending in the generatrix direction, wherein an image formed on a recording material is fixed on the recording material by heat from the cylindrical fixing member.

According to a further aspect of the present invention, there is provided an image forming apparatus comprising: an image forming portion for forming an image on a recording material; and a fixing portion for fixing the image on the recording material, wherein the fixing portion includes a cylindrical fixing member including a heat generating layer and an electrode layer contacting the heat generating layer, wherein the electrode layer is smaller in volume resistance value than the heat generating layer, wherein the electrode layer is formed in a helical shape so that a helical axis thereof extends in a direction along a generatrix direction of the fixing member, and wherein one end and the other end of the electrode layer are electrically open; a coil provided at a hollow portion of the cylindrical fixing member, wherein the coil includes a helical-stepped portion having a helical axis extending in a direction along the generatrix direction of the cylindrical fixing member, and forms a magnetic field for subjecting the heat generating layer to electromagnetic induction heating by causing an alternating current to flow through the coil; and a magnetic core provided inside the helical-stepped portion of the coil and extending in the generatrix direction, wherein the image recording material is fixed on the recording material by heat from the cylindrical fixing member.

Further features of the present invention will become apparent from the following description of exemplary embodiments with reference to the attached drawings.

DESCRIPTION OF EMBODIMENTS

Embodiments of the present invention will be described specifically with reference to the drawings. Although the following embodiments are examples of preferred embodiments of the present invention, the present invention is not limited thereto, but various constitutions thereof can also be replaced with other known constitutions within the scope of the concept of the present invention.

[Embodiment 1]

1. Image Forming Apparatus 100

Figure 18:
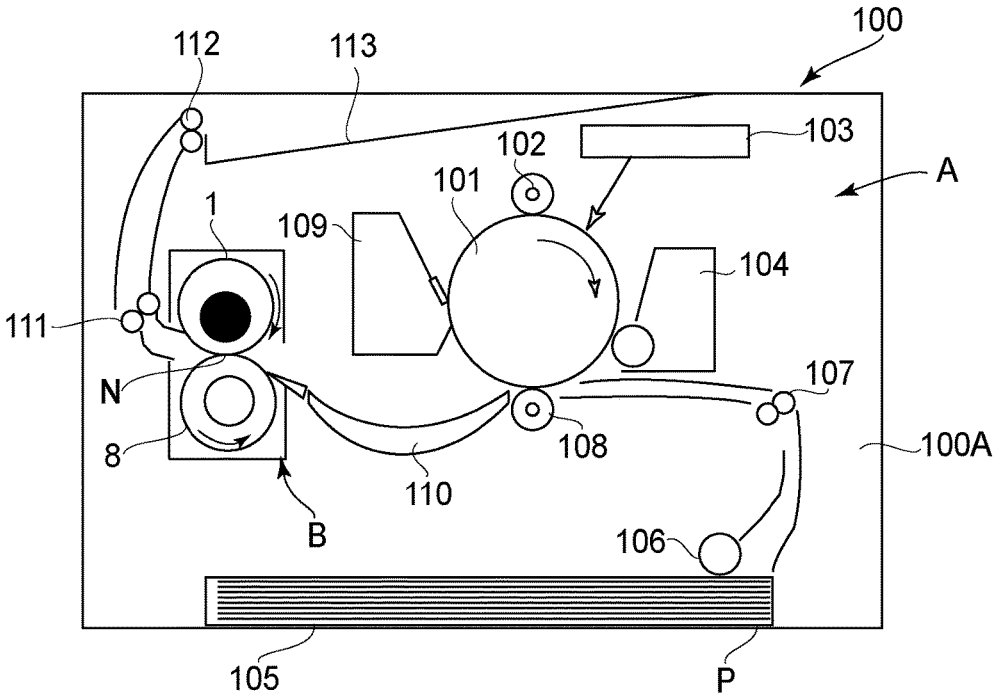
FIG. 18 is a sectional view of an image forming apparatus.

With reference to FIG. 18, an image forming apparatus 100 according to the present invention will be described. FIG. 18 is a sectional view showing a general structure of the image forming apparatus 100 (monochromatic printer in this embodiment) using electrophotographic technology.

In the image forming apparatus 100, an image forming portion A for forming a toner image (which has not been fixed) on a recording material P includes a photosensitive drum 101 as an image bearing member, a charging member 102, a laser scanner 103 and a developing device 104. The image forming portion A further includes a cleaner 109 for cleaning the photosensitive drum 101, and a transfer member 108. An operation of the image forming portion A is well known and therefore will be omitted from detailed description.

The recording material P, such as recording paper, accommodated in a cassette 105 in a main assembly 100A of the image forming apparatus 100 is fed one by one by rotation of a roller 106. The recording material P is fed by rotation of a roller 107 to a transfer nip formed by the photosensitive drum 101 and a transfer member 108. The recording material P on which a toner image is transferred at the transfer nip is sent to the fixing portion (hereinafter referred to as a fixing device) B via a feeding guide 110. An unfixed toner image T formed on the recording material P is heat-fixed on the recording material P by the fixing device B. The recording material P coming out of the fixing device B is discharged onto a tray 113 by rotation of a roller pair 111 and a roller pair 112.

1. Fixing Device (First Heating Device) B

Figure 1:
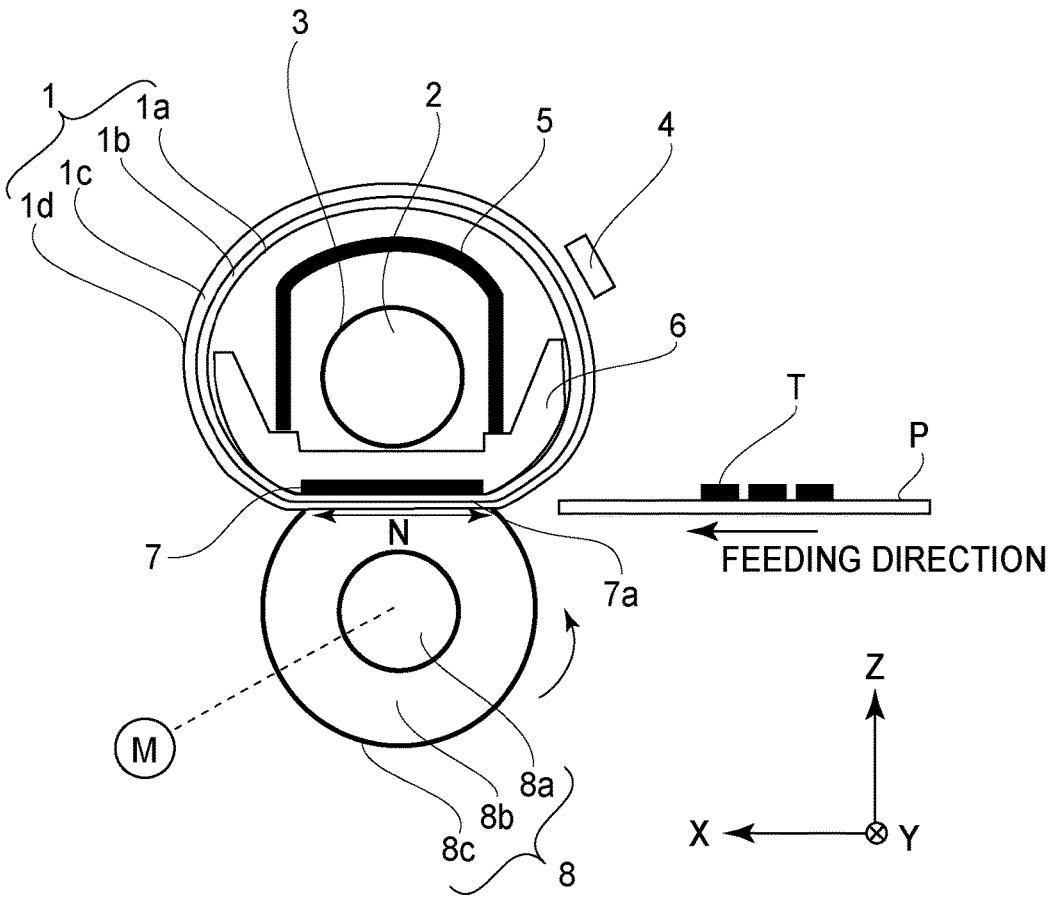
FIG. 1 is a sectional view of a fixing device according to Embodiment 1.
Figure 2:
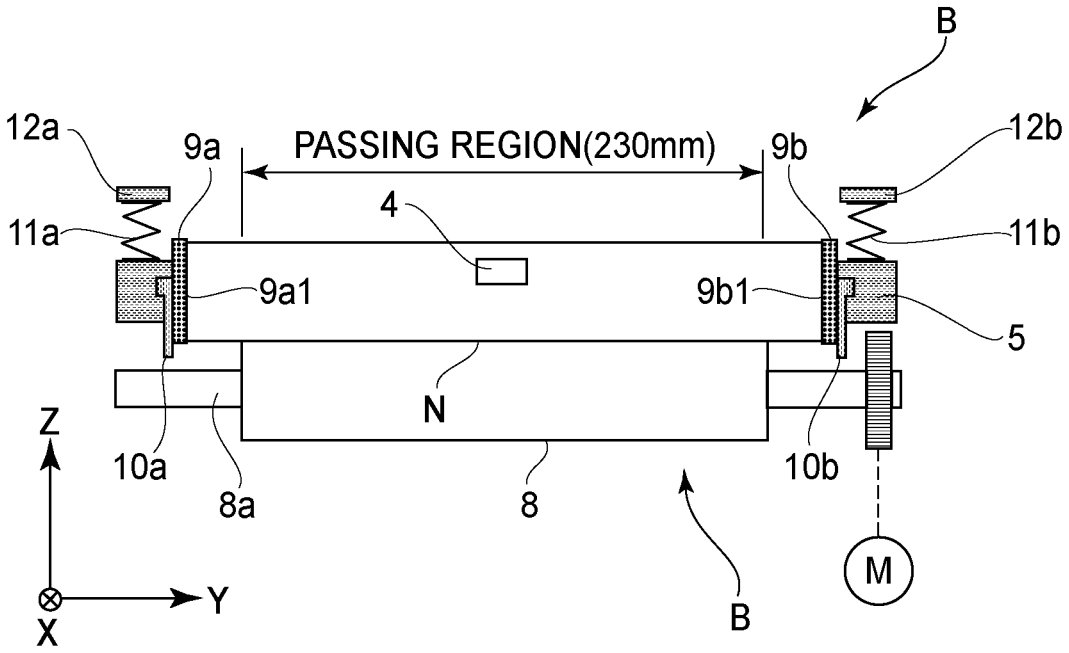
FIG. 2 is a front view of the fixing device.

The fixing device B is a fixing device of an electromagnetic induction heating type. FIG. 1 is a sectional view showing a general structure of the fixing device B in this embodiment. FIG. 2 is a front view of the fixing device B as seen from an upstream side with respect to a feeding direction X of the recording material P.

A pressing roller 8 as a pressing member includes a more metal 8*a*, an elastic layer 8*b* formed on an outer peripheral surface of the core metal 8*a*, and a parting layer 8*c* formed at on outer peripheral surface of the elastic layer 8*b*. As a material of the elastic layer 8*b*, a material having a good heat-resistant property such as a silicone rubber, a fluorine-containing rubber or a fluorosilicone rubber may preferably be used. As the parting layer 8*c*, a material, having a good parting property and a good heat-resistant property, such as PFA, PTFE or FEP can be selected. With respect to a direction (hereinafter referred to as a Y-axis direction) perpendicular to the feeding direction (hereinafter referred to as an X-axis direction) of the recording material P, both end portions of the core metal 8*a* are rotatably supported by left and right side plates (not shown) of the fixing device B via bearings.

With respect to Z-axis direction perpendicular to both of the X-axis direction and the Y-axis direction, a cylindrical film 1 as a cylindrical rotatable heating member (fixing member) is provided opposed to a pressing roller 8. On a film guide 6 inserted into a hollow portion of the film 1, a metal-made sty 5 for reinforcing the guide 6 is provided. The guide 6 is prepared using PPS (polyphenylene sulfide) resin or the like having a heat-resistant property.

With respect to the Y-axis direction, at both end portions of the stay 5, flanges 9*a* and 9*b* formed of a heat-resistant resin material are externally engaged. The flange 9*a* is fixed to a left-hand frame by a regulating member 10*a*, and the flange 9*b* is fixed to a right-hand frame by a regulating member 10*b*. Each of the flanges 9*a* and 9*b* holds an inner peripheral surface (inner surface) of an associated film end portion by a holding portion (not shown) thereof inserted into the hollow portion of the film 1. Further, the respective flanges 9*a* and 9*b* receive the end portions of the film 1 by film-side regulating surfaces 9*a*1 and 9*b*1 during rotation of the film 1 and regulate (limit) lateral movement of the film 1 along a generatrix direction of the film 1.

With respect to the Y-axis direction, between both end portions of the stay 5 and left and right side plate-side spring-receiving members 12*a* and 12*b*, pressing springs 11*a* and 11*b* (FIG. 2) are compressedly provided, so that a pressing-down force is caused to act on the stay 5. In the fixing device in this embodiment, a pressing force of about 100N-250N (about kgf-25 kgf) in total pressure is applied to the stay 5. A plate-like slidable member 7 held on a flat surface of the guide 6 in the pressing roller 8 side is pressed on the film 1 toward an outer peripheral surface of the pressing roller 8 by the pressing force, so that the pressing roller 8 forms a nip N (FIG. 1) with a predetermined width in cooperation with the film 1.

The pressing roller 8 is rotated in an arrow direction (FIG. 1) by drive of a motor M as a driving means. The film 1 is rotated in an arrow direction by the rotation of the pressing roller 8 while sliding with a sliding surface 7*a* of the slidable member 7 at an inner surface thereof in the pressing roller 8 side. During a rotational operation of the film 1, in order to reduce a sliding frictional force between the inner surface of the film 1 and the sliding surface 7*a*, it is possible to interpose a lubricant such as heat-resistant grease between the film inner surface and the sliding surface. With respect to the Y-axis direction, at both end portions of the guide 6, the flanges 9*a* and 9*b* as regulating (limiting) members for regulating (limiting) the lateral movement of the film 1 by receiving the end portions of the film 1 during the rotation of the film 1 are externally engaged.

Figure 3:
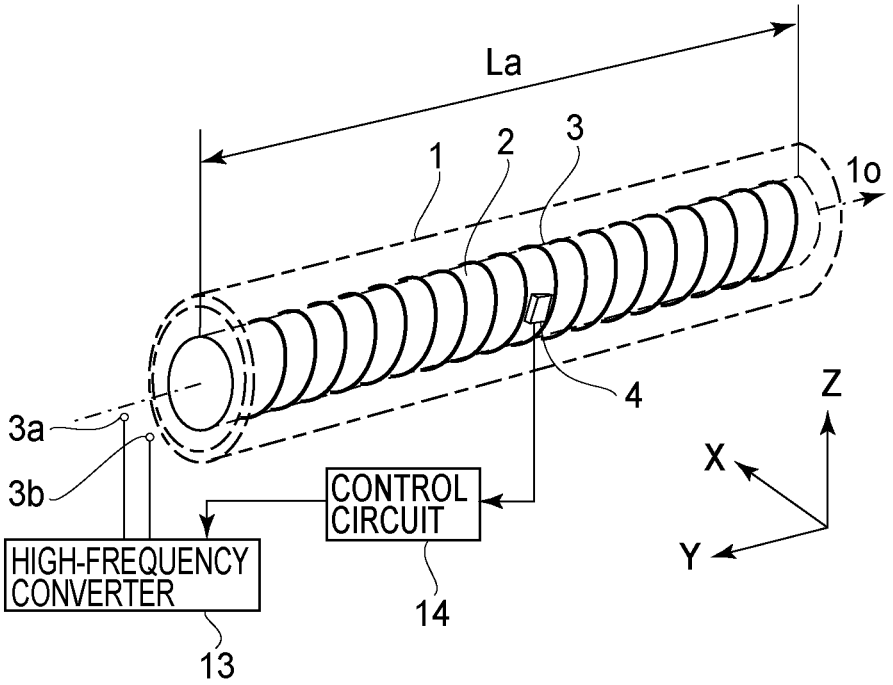
FIG. 3 is a schematic view for illustrating electromagnetic induction heating of a heat generating layer.

FIG. 3 is a schematic view for illustrating electromagnetic induction heating of a heat generating layer 1*a* by a magnetic core 2 and an exciting coil 3.

The magnetic core 2 as a magnetic core material has a cylindrical shape of La in length with respect to the Y-axis direction, and is disposed by an unshown fixing means so as to penetrate through the hollow portion of the film 1. That is, the core 2 is inserted into the hollow portion of the film 1 and is disposed along the generatrix direction of the film 1.

The core 2 induces magnetic lines of force (magnetic fluxes), by an alternating magnetic field generated by the exciting coil 23 as a magnetic field generating means, into (the inside of) the film 1, and functions as a member for forming a path (magnetic path) of the magnetic lines of force.

The core 2 may preferably be formed of a material having small hysteresis loss and high relative permeability. For example, ferromagnetic materials constituted by high-permeability oxides or alloy materials such as calcined ferrite, ferrite resin, amorphous alloy and permalloy are used. It is desirable that the core 2 has a large cross-sectional area to the extent possible within a range in which the core 2 is accommodatable in the film 1 which is a cylindrical member. The shape of the core 2 is not limited to the cylindrical shape, but it is also possible to select a polygonal prism shape or the like.

The coil 3 is formed by winding an ordinary single lead wire helically around the core 2 at the hollow portion of the film 1 in a winding number (number of turns) of about 10 to about 40. In this embodiment, the coil 3 is constituted by the winding in the winding number of 18. The coil 3 is wound inside the film 1 in the direction crossing a rotational axis 1*o* of the film 1. For this reason, when a high-frequency current is caused to flow into the coil 3 via a high-frequency converter 13 and energization contact portions 23*a* and 23*b*, the alternating magnetic field, in which a polarity is periodically reversed, can be generated in a rotational axis direction of the film 1. The coil 3 includes a helical-shaped portion where the coil 3 is helically wound so that a helical axis thereof extends in a direction along the generatrix direction of the film 1. The core 2 is provided inside the helical-shaped portion of the coil 3.

A control circuit 14 controls the high-frequency converter 13 on the basis of a temperature detected by a temperature detecting element 4 provided at a center of a passing region (230 mm) of the film 1, with respect to the Y-axis direction, in which the recording material P passes. As a result, a surface temperature of the film 1 is maintained at a predetermined target temperature (about 150° C.-200° C.) by subjecting the film 1 to electromagnetic induction heating.

The recording material P carrying thereon the unfixed toner image T is heated at the nip N while being fed through the nip N, so that the toner image is fixed on the recording material.

3. Structure and Manufacturing Method of Film

Figure 4:
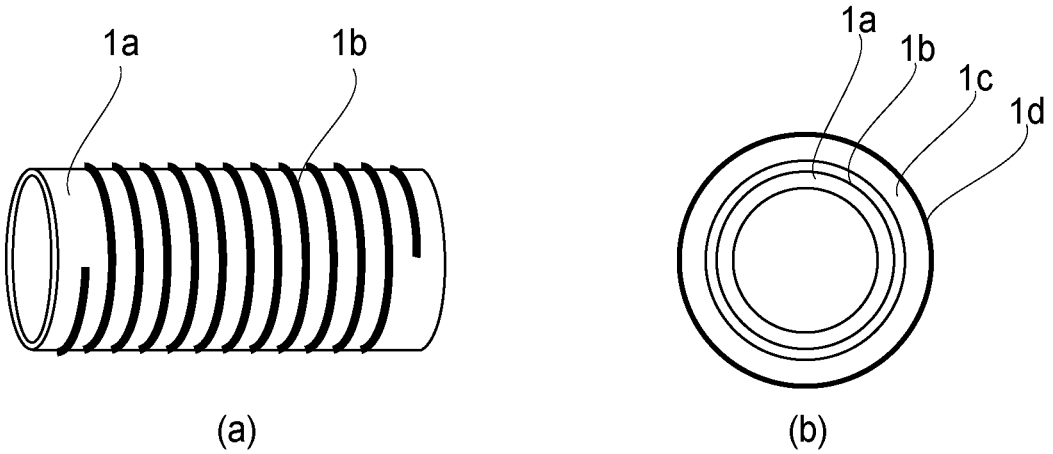
In FIG. 4, (a) and (b) are schematic views for illustrating a structure of a film.

In FIG. 4, (a) is a perspective view showing the heat generating layer 1*a* of the film 1 and an electrode layer 1*b* formed on an outer peripheral surface of the heat generating layer 1*a*, and (b) is a schematic view for illustrating a layer structure of the film 1.

As shown in (b) of FIG. 4, the film 1 is a cylindrical rotatable member having a composite structure including a cylindrical heat generating layer 1*a*, the electrode layer 1*b*, an elastic layer 1*c* and a parting layer 1*d*. That is, the film 1 includes the electrode layer 1*b* helically formed on an outer peripheral surface of the cylindrical heat generating layer 1*a* prepared with an electroconductive member. The electrode layer 1*b* contacts the surface of the heat generating layer 1*a*. The elastic layer 1*c* is laminated so as to cover the electrode layer 1*b* formed on the surface of the heat generating layer 1*a*, and then the parting layer 1*d* is laminated on an outer peripheral surface of the elastic layer 1*c*.

A detailed structure and a manufacturing method of the film 1 will be described while making reference to (a) and (b) of FIG. 4.

First, the heat generating layer 1*a* is formed of a heat-resistant resin material such as polyimide, polyamideimide, PEEK or PES in which electroconductive particles such as carbon black or metal powder are added and dispersed, and is molded in a cylindrical shape of 30 μm-100 μm in thickness. In this embodiment, the polyimide resin material is molded using a die in a cylindrical shape of 30 mm in inner diameter, 240 mm in longitudinal length and 50 μm in thickness, so that the heat generating layer 1*a* was formed.

Next, the electrode layer 1*b* is prepared by helically forming an electroconductive wire, on the surface of the heat generating layer 1*a*, formed of a material smaller in volume resistivity than the material of the heat generating layer 1*a*. Here, the electroconductive wire is formed of iron, copper, silver, aluminum, nickel, chromium, tungsten, SUS 304 containing these metals, an alloy such as nichrome, or an electroconductive resin material such as CFRP (carbon fiber reinforced plastic) or carbon nanotube resin. The electrode layer 1*b* has a helical shape such that a helical axis thereof extends in a direction along the generatrix direction of the film 1.

Here, a helical pitch interval of the electrode layer 1*b* most suitable for a heat generation principle described later will be described. The helical pitch interval of the electrode layer 1*b* varies depending on a volume resistivity of the electroconductive member used as the material of the heat generating layer 1*a*. Further, when a diameter (layer thickness) of the electroconductive member of the electrode layer 1*b* is excessively large, an unevenness shape thereof is not completely absorbed by the elastic layer 1*c* to result in hardness non-uniformity, and pressure non-uniformity due to the hardness non-uniformity appears as an image non-uniformity in some cases. Therefore, the diameter (layer thickness) of the electroconductive member of the electrode layer 1*b* may be 200 μm or less and may desirably be small to the extent possible.

In this embodiment, a core was inserted into a hollow portion of the heat generating layer 1*a* so that the heat generating layer 1*a* was not deformed during formation of the electrode layer 1*b*, and with respect to the Y-axis direction, a winding start end portion of the electroconductive wire formed of SUS 304 in a diameter of 50 μm was bonded with a heat-resistant adhesive in Comparison Example side of the surface of the heat generating layer 1*a*. Then, the electroconductive wire is equidistantly wound around the heat generating layer surface along the generatrix direction of the heat generating layer 1*a* by an axis rotation method, whereby the electrode layer 1*b* having the helical shape was formed. Also a winding end portion of the electroconductive wire was bonded with the heat-resistant adhesive in the other end side of the surface of the heat generating layer 1*a*.

Then, the elastic layer 1*c* was formed along the generatrix direction of the heat generating layer 1*a* so as to cover the electrode layer 1*b* on the surface of the heat generating layer 1*a* in a state shown in (a) of FIG. 4. The elastic layer 1*c* is formed in an entire passing region (230 mm) shown in FIG. 2. In this embodiment, the elastic layer 1*c* was formed of silicone rubber of 20 degrees in hardness (JIS-A, load: 9.8 N (1 kgf) by spray coating so as to have a thickness of 300 mm (350 μm at a portion free from the electrode layer 1*b*). The elastic layer 1*c* has functions of suppressing the pressure-uniformity and the heat non-uniformity. An optimum thickness of the elastic layer 1*c* varies depending on the diameter and a helical pitch of the electrode layer 1*b*. Here, the thickness is a dimension with respect to the Z-axis direction.

Then, a 30 μm-thick fluorine-containing resin tube was coated as the parting layer 1*d* on the surface of the elastic layer 1*c* along the generatrix direction of the heat generating layer 1*a* by a heat contraction method. The parting layer 1*d* has a function of preventing contamination of the surface of the film 1 with the toner or paper dust deposited thereon.

4. Heat Generation Principle of Film 1

First, the case where the electrode layer 1*b* does not exist, i.e., a heat generation principle in a conventional type will be described.

Figure 5:
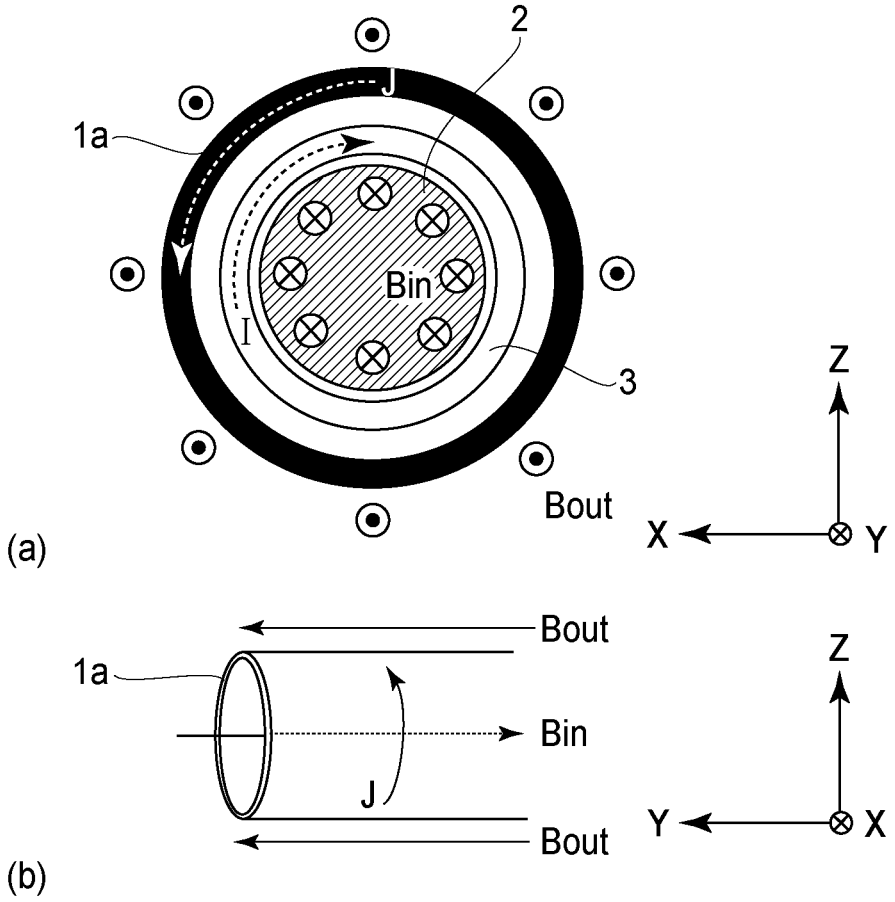
In FIG. 5, (a) and (b) are schematic views for illustrating a current and a magnetic field of the heat generating layer.

In FIG. 5, (a) is a schematic view showing a current and a magnetic field in cross-section of the heat generating layer 1*a*, and (b) is a schematic view showing the current and the magnetic field with respect to the generatrix direction of the heat generating layer 1*a*.

In (a) of FIG. 5, from the center of the heat generating layer 1*a*, the core 2, the coil 3 and the heat generating layer 1*a* are concentrically disposed. With respect to the Y-axis direction, the magnetic lines of force indicated by arrows toward a depth direction on the drawing sheet are represented by "Bin" (x in o), and the magnetic lines of force indicated by arrows toward a front direction on the drawing sheet are represented by "Bout" (● in o).

At the instant when the current increases in the coil 3 with respect to an arrow I direction, the magnetic lines of force are formed in the magnetic path as indicated by the arrows (x in o) toward the depth direction on the drawing sheet. That is, the number of the magnetic lines of force "Bin" passing through the core 2, inside the heat generating layer 1*a*, in the depth direction, and also the number of the magnetic lines of force "Bout" return toward the front direction outside the heat generating layer 21*a* is are the same. When the alternating magnetic field is formed in actuality, an indicated electromotive force is exerted over a full circumferential region of the heat generating layer 1*a* so as to cancel the magnetic lines of force which are formed as described above, so that the current passes through the heat generating layer 1*a* so as to move in the circumferential direction of the heat generating layer 1*a* as indicated by an arrow J (hereinafter, referred to as a circumferential current J).

The indicated electromotive force is exerted in the circumferential direction of the heat generating layer 1*a*, and therefore the circumferential current J uniformly flows inside the heat generating layer 21*a*. The magnetic lines of force repeats generation and extinction and direction reversal by the high-frequency current and therefore the loop current J flows in synchronism with the high-frequency current while repeating the generation and extinction and the direction reversal. When the current flows into the heat generating layer 1*a*, due to an electric resistance of the heat generating layer 1*a*, Joule heat generates in the heat generating layer 1*a*.

The Joule heat generation is called "iron loss (core loss)" in general, and a heat generation amount Pe is represented by the following formula (1):

$$P_e = k_e \frac{(tfB_m)^2}{\rho} \tag{1}$$

Pe: heat generation amount t: film thickness f: frequency

Bm: maximum magnetic flux density

ρ: resistivity ke: constant of proportionality

The magnetic lines of force generated by the core 2 generates in parallel to the direction of the rotational axis of the film 1, and therefore the circumferential current J flows in the direction perpendicular to the rotational axis direction of the film 1.

The circumferential current J generated as described above depends on the magnetic flux in the film 1 and the resistance value of the heat generating layer 1*a*. Further, in a range in which the resistance value of the heat generating layer 1*a* does not change extremely, the circumferential current J is independent of also the thickness of the material of the heat generating layer 1*a*. Further, even in the case where as the material of the heat generating layer 1*a*, an electroconductive resin material or the like other than the metal material is used, it is possible to cause the heat generating layer 1*a* to generate heat in principle. Therefore, in the type using the circumferential current J as in this embodiment, compared with an electromagnetic induction heating type using eddy current, it is possible to enlarge a degree of design latitude in terms of the material, the thickness and the frequency of the heat generating layer 1*a*.

As the heat generation other than that of the film 1 in a system in which the induction heating is carried out, heat generation of a primary-side coil winding due to copper loss and heat generation of the core 2 due to iron loss also exist. The heat generation of the primary-side coil winding and the heat generation of the core 2 do not contribute directly to the heat generation of the film 1, and therefore a material which does not readily generate the copper loss and the iron less so as to efficiently heat the film 1 while minimizing degrees of the heat generation of the primary-side winding and the heat generation of the core 2.

Figure 6:
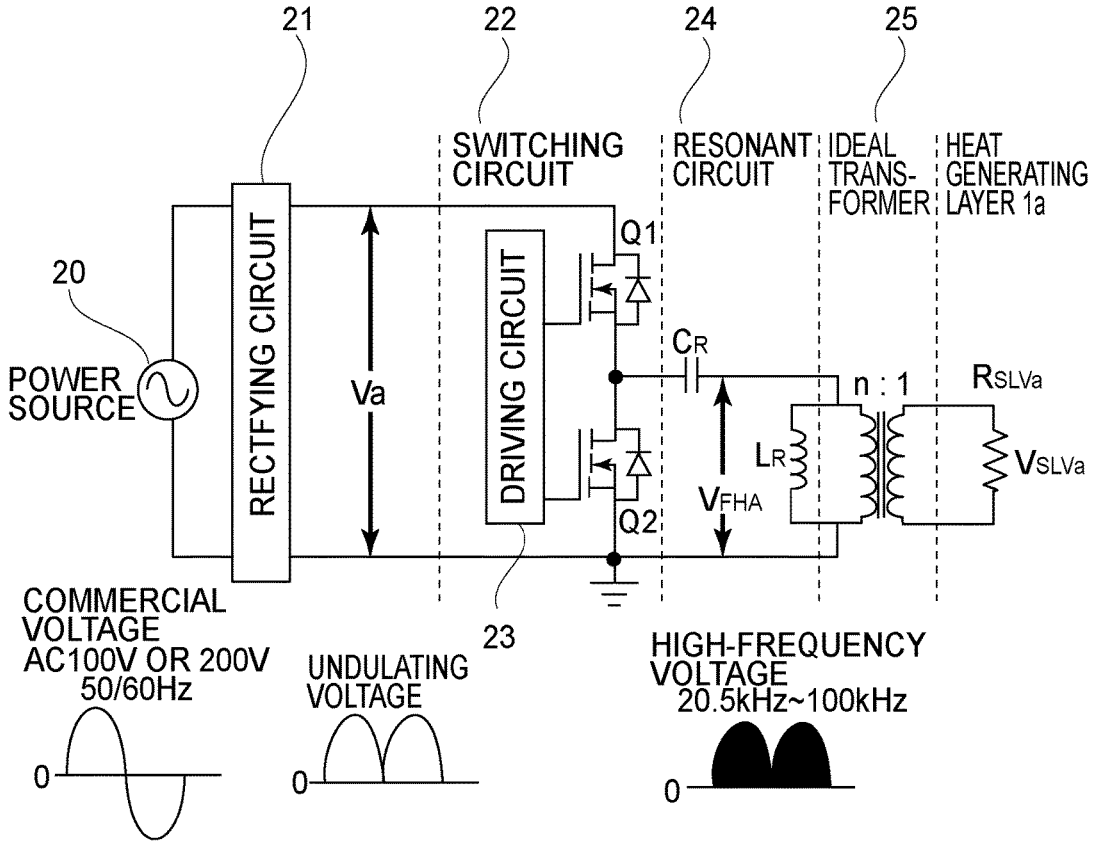
FIG. 6 is a circuit diagram for illustrating a series resonant circuit and a relationship between an exciting coil and the heat generating layer.

FIG. 6 is a circuit diagram for illustrating a series resonant circuit and a relationship between the coil 3 and the heat generating layer 1*a*. In this circuit diagram, a circuit is divided into a commercial power source 20, a rectifying circuit 21, a high-frequency switching circuit 22, a resonant circuit 24, an ideal transformer 25 and the heat generating layer 1*a*.

A commercial AC voltage (e.g., AC 100 V or AC 200 V, 50/60 Hz) obtained from the commercial power source 20 is converted into an undulating voltage by the rectifying circuit 21, and is supplied to the high-frequency switching circuit 22.

Then, a voltage Va converted into the undulating voltage is supplied to the resonant circuit 24 in the form of a high-frequency current (e.g., at 20.5 kHz-100 kHz) by a switching element such as an insulated gate bipolar transistor (hereinafter simply referred to as "IGBT"). Drive (switching between an on-state and an off-state) of the IGBT is controlled by a driving circuit 23.

In the resonant circuit 24, a resonant capacitor $C_R$ and an exciting coil $L_R$ constitute the series resonant circuit. In the high-frequency converter 13, a relationship between an effective voltage Va supplied to the high-frequency switching circuit 22 and an effective voltage $V_{FHA}$ supplied to the resonant circuit 24 can be represented by a formula (2) shown below according to description of publications 1 and 2 shown below.

$$V_{FHA} = \frac{\sqrt{2}}{\pi} V_a \tag{2}$$

Va: effective voltage of commercial power source

The publication 1 is "LLC resonant half-bridge converter design guideline, APPLICATION NOTE AN2450". The publication 2 is "Half-Bridge LLC Resonant Converter Design Using FSFR-Series Fairchild Power Switch (FPS), APPLICATION NOTE AN4151".

Incidentally, the relationship between the effective voltage $V_{FHA}$ and a maximum of the voltage of the commercial power source 20 is represented by the following formula (3)

$$V_{FHA} = \frac{\sqrt{2}}{\pi} \times \frac{1}{\sqrt{2}} \times V_m = \frac{V_m}{\pi} \tag{3}$$

Vm: maximum of voltage of commercial power source

5. Calculating Method of Power by Transformer Model

Figure 7:
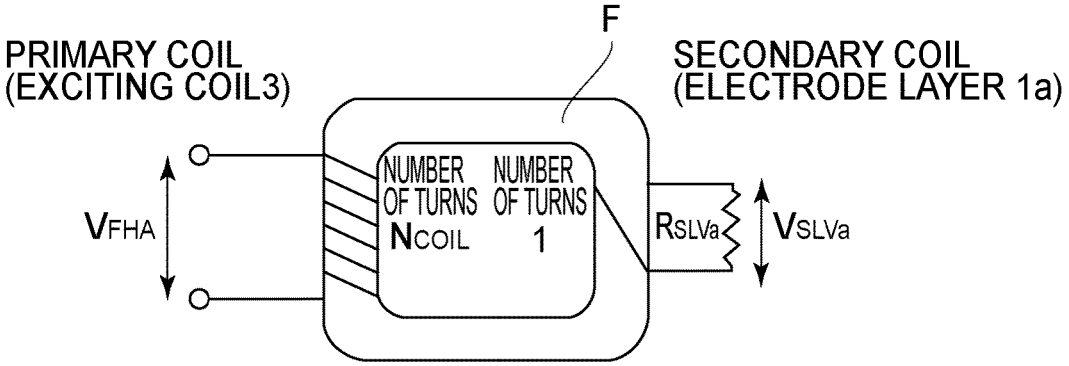
FIG. 7 is a schematic model view of a transformer including the exciting coil and the heat generating layer.

FIG. 7 is a schematic model view of a transformer including the coil 3 and the heat generating layer 1*a*. A relationship between a voltage $V_{FHA}$ applied to the coil 3 and a heat quantity (=electric power) $P_{SLV}$ generating in the heat generating layer 1*a* can be estimated from a formula of a transformer ratio of the transformer. The high-frequency voltage $V_{FHA}$ is generated in a primary winding side (coil 3), with the result that an induced electromotive force $V_{SLV}$ is exerted on a secondary winding side (heat generating layer 1*a*) via a core F and then is consumed as heat by a resistor $R_{SLV}$, so that the heat quantity (=electric power) $P_{SLV}$ is generated.

In the case where the electrode layer 1*b* having the helical shape does not exist, only the heat generating layer 1*a* constitutes the secondary-side coil. In this case, the winding number (number of turns) of the secondary-side coil can be regarded as 1, and therefore when the winding number of the primary-side coil (coil 3) is defined as $N_{COIL}$, from the formula of the transformer ratio, a relationship of the following formula (4) is satisfied among $V_{FHA}$, $V_{SLVa}$ and $N_{COIL}$.

$$\frac{N_{COIL}}{1} = \frac{V_{FHA}}{V_{SLVa}} \tag{4}$$

$N_{COIL}$: winding number of primary-side coil (coil 3)

$V_{FHA}$: voltage applied to primary-side coil (coil 3)

$V_{SLVa}$: induced electromotive force of secondary-side (heat generating layer 1*a*)

By modifying the formula (4), the following formula (5) is obtained.

$$V_{SLVa} = \frac{1}{N_{COIL}} \times V_{FHA} \tag{5}$$

When, heat quantity (=electric power) generating in the heat generating layer 1*a* is defined as $P_{SLVa}$ and a circumferential resistance of the heat generating layer 1*a* is defined as $R_{SLVa}$, by using the formula (5), a relationship of the following formula (6) is obtained.

$$P_{SLVa} = \frac{V_{SLVa}^2}{R_{SLVa}} = \frac{\left(\frac{V_{FHA}}{N_{COIL}}\right)^2}{R_{SLVa}} \tag{6}$$

The circumferential surface $R_{SLVa}$ of the heat generating layer 1*a* is an electric resistance when the current flows in the circumferential direction of the heat generating layer 1*a*.

Figure 8:
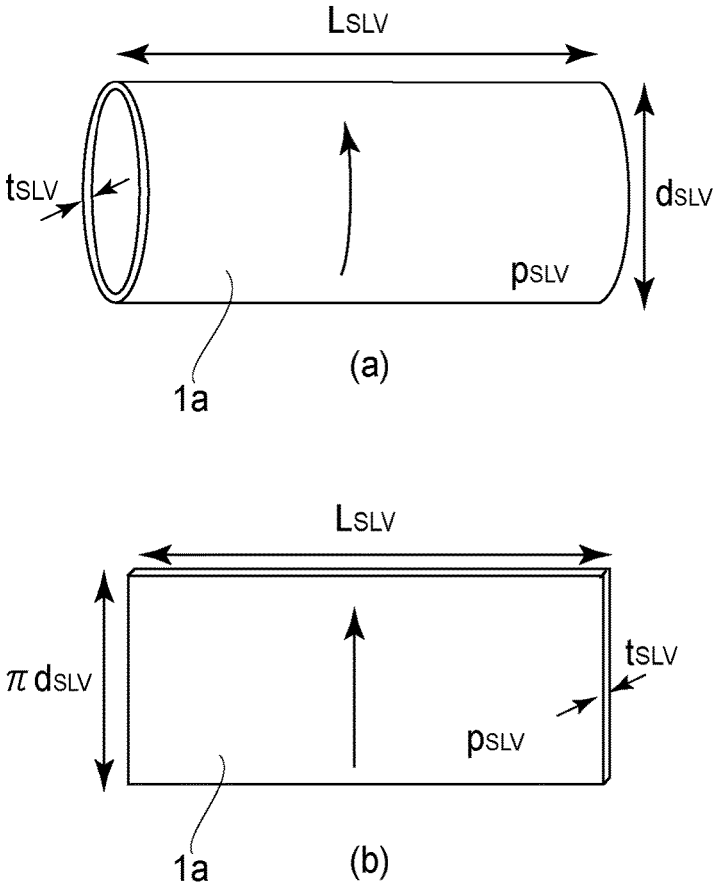
In FIG. 8, (a) and (b) are schematic views showing a shape of the heat generating layer and a calculating method of a circumferential resistance.

In (a) of FIG. 8, a shape of the heat generating layer 1*a* and a calculating method of the circumferential resistance $R_{SLVa}$ are shown. In the case where the heat generating layer 1*a* is $L_{SLV}$ (m) in length with respect to the Y-axis direction, $d_{SLV}$ (m) in diameter, $t_{SLV}$ (m) in thickness and $\rho_{SLV}$ (Ωm) in volume resistivity, the electric resistance when the cylinder is cut and developed as shown in (b) of FIG. 8 and then the current is caused to flow in an arrow R direction is represented by the following formula (7).

$$R_{SLVa} = \frac{\rho_{SLV} \times \pi d_{SLV}}{t_{SLV} \times L_{SLV}} \tag{7}$$

A generated heat quantity in the case of the commercial power source of 100 V will be described. Respective numerical values are shown in Table 1.

TABLE 1

| Item | Symbol | Numerical value | Unit |
|---|---|---|---|
| D*1 | d | $3.0 \times 10^{-2}$ | m |
| T*2 | t | $3.5 \times 10^{-5}$ | m |
| L*3 | L | $2.3 \times 10^{-1}$ | m |
| WN*4 | $N_{COIL}$ | 16 | — |

*1"D" is the diameter.
*2"T" is the thickness.
*3"L" is the length.
*4"WN" is the winding number (number of turns).

In the above condition, in each of the case where as the material of the heat generating layer 1*a*, SUS 304 is employed and the case where as the material of the heat generating layer 1*a*, polyimide to which electroconductivity is imparted by adding carbon black is employed, the generated heat quantity will be calculated. The volume resistivity of SUS 304 is about $7.0\times10^{-7}$ Ωm. The generated heat quantity calculated from this volume resistivity value is shown in Table 2.

TABLE 2

| Item | Symbol | Numerical value | Unit |
|---|---|---|---|
| CR*1 | $R_{SLVa}$ | $8.2 \times 10^{-3}$ | Ω |
| GHQ*2 | $P_{SLVa}$ | 965.9 | W |

*1"CR" is the circumferential resistance.
*2"GHQ" is the generated heat quantity.

The circumferential resistance is a value capable of providing a heat quantity enough to ensure a fixing property while satisfying a rating of the 100 V-commercial power source. In actuality, when heat generation was checked using the film formed of SUS 304 as the heat generating layer 1*a*, it was able to be confirmed that the heat was quickly generated at a sufficient speed.

On the other hand, the volume resistivity of carbon black is about $1.0\times10^{-5}$ and therefore the volume resistivity of polyimide to which electroconductivity is imparted by adding carbon black, is not lower than the volume resistivity of carbon black. In actuality, the volume resistivity of the polyimide to which electroconductivity is imparted by adding carbon black is about $5.0\times10^{-4}$ Ωm. The generated heat quantity calculated from this volume resistivity value of the electroconductive polyimide is shown in Table 3.

TABLE 3

| Item | Symbol | Numerical value | Unit |
|---|---|---|---|
| CR*1 | $R_{SLVa}$ | $5.9 \times 10^{-0}$ | Ω |
| GHQ*2 | $P_{SLVa}$ | 1.4 | W |

*1"CR" is the circumferential resistance.
*2"GHQ" is the generated heat quantity.

The circumferential resistance is excessively high and therefore the circumferential current little flows, and thus is a value failing to provide a heat quantity necessary for the fixing device B. In actuality, when heat generation was checked using the film formed of the electroconductive polyimide as the heat generating layer 1*a*, a result thereof was such that the heat generating layer 1*a* little generates heat.

Next, the heat generation principle in the case where the constitution of the film 1 in this embodiment is employed will be described, and then an estimated value of the generated heat quantity and an experimental result will be described.

A feature of the film 1 in this embodiment is in that the helically shaped electrode layer 1*b* is formed on the heat generating layer 1*a*. As the heat generating layer 1*a*, the above-described electroconductive polyimide of about $5.0\times10^{-4}$ Ωm in volume resistivity was used. Further, the helically shaped electrode layer 1*b*, the layer of SUS 304 having a diameter of 50 μm and a volume resistivity of about $7.0\times10^{-7}$ was used.

Figure 9:
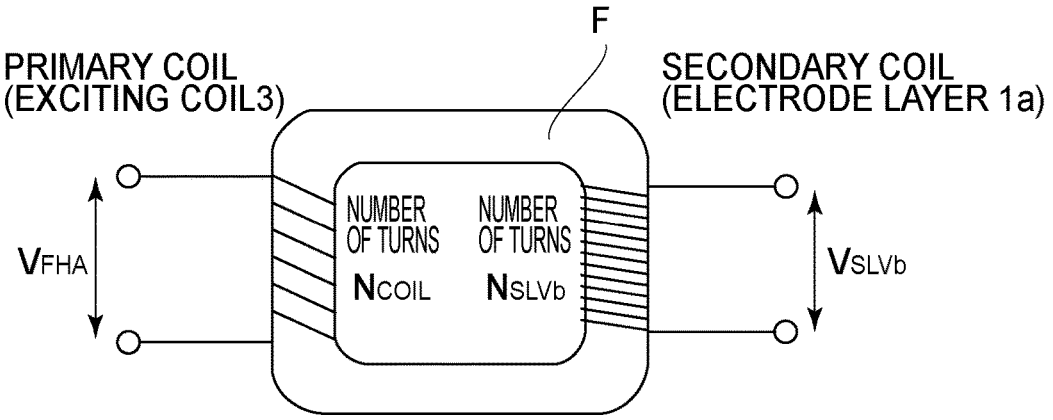
FIG. 9 is a schematic model view of a transformer including the exciting coil and an electrode layer.

As described above, in the heat generating layer 1*a*, although the circumferential current J generates but an amount thereof is slight, and therefore the heat generating layer 1*a* itself little generates the heat due to the circumferential current. However, the volume resistivity of the electrode layer 1*b* is low equivalently to the metal and the electrode layer 1*b* has the helical shape, and therefore a sufficient induced electromotive force $V_{SLVb}$ generates at both ends of the electrode layer 1*b*. That is, in the case where the helically shaped electrode layer 1*b* exists, also the electrode layer 1*b* constitutes the secondary-side coil. FIG. 9 is a schematic model view of a transformer including the coil 3 and the electrode layer 1*b*. The winding number (number of turns) of the secondary-side coil is a helical winding number of the electrode layer 1*b*, and from the formula of the transformer ratio, a relationship of the following formula (8) is satisfied among $V_{FHA}$, $V_{SLVb}$, $N_{COIL}$ and $N_{SLVb}$.

$$\frac{N_{COIL}}{N_{SLVb}} = \frac{V_{FHA}}{V_{SLVb}} \tag{8}$$

$N_{COIL}$: winding number of primary-side coil (coil 3)
$V_{FHA}$: voltage applied to primary-side coil (coil 3)
$N_{SLV}$: helical width number of electrode layer 1*b*
$V_{SLVa}$: induced electromotive force of secondary-side (heat generating layer 1*a*)

By modifying the formula (8), the following formula (9) is obtained.

$$V_{SLVb} = \frac{N_{SLVb}}{N_{COIL}} \times V_{FHA} \tag{9}$$

Figure 10:
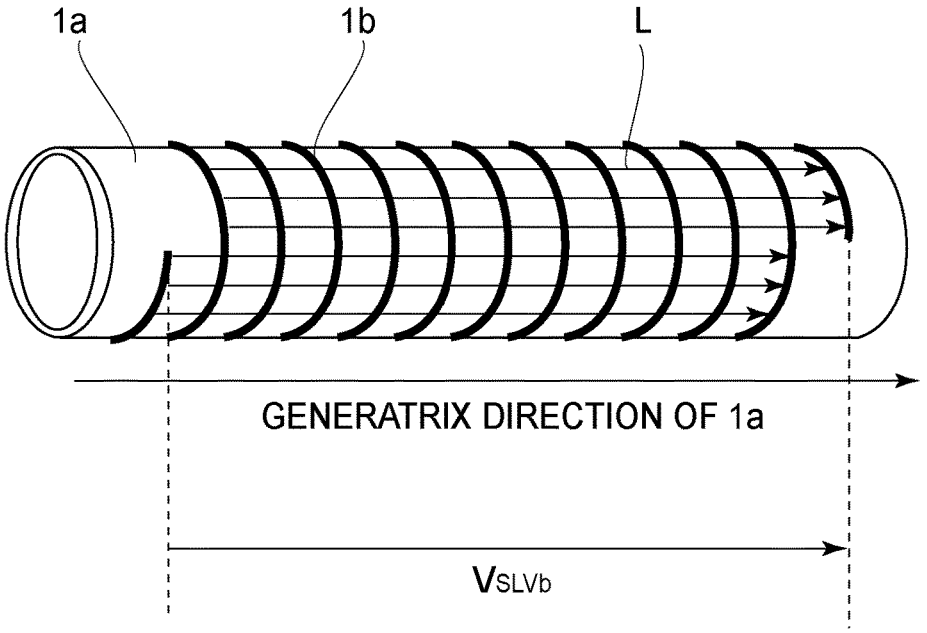
FIG. 10 is a schematic view for illustrating an induced electromotive force generated with respect to a generatrix direction of the heat generating layer.

A potential difference formed is proportional to the helical winding number of the electrode layer 1*b*. That is, with an increasing helical winding number, the potential difference formed by the electrode layer 1*b* with respect to the generatrix direction of the heat generating layer 1*a* becomes larger. Then, as shown in FIG. 10, by the potential difference of the induced electromotive force $V_{SLVb}$ generated with respect to the generatrix direction of the heat generating layer 1*a*, a current L flows through the electroconductive polyimide of the heat generating layer 1*a* in the generatrix direction of the heat generating layer, and is at a level such that the heat quantity generates.

In a conventional type, the diameter in which the current flows is the circumferential direction, but in the type in this embodiment, the current flowing direction is the generatrix direction of the heat generating layer 1*a* as a feature of this embodiment. Thus, even when the volume resistivity of the heat generating layer 1*a* is large, it becomes possible to increase the induced electromotive force $V_{SLVb}$ by increasing the helical winding number of the electrode layer 1*b*. That is, even a material high in volume resistivity to some extent can provide a sufficient generated heat quantity.

When, heat quantity (=electric power) generating in the heat generating layer 1*a* by the current flowing in the generatrix direction of the heat generating layer 1*a* is defined as $P_{SLVb}$ and a resistance of the heat generating layer 1*a* with respect to the generatrix direction is defined as $R_{SLVb}$, by using the formula (9), a relationship of the following formula (10) is obtained.

$$P_{SLVb} = \frac{V_{SLVb}^2}{R_{SLVb}} = \frac{\left(\frac{N_{SLVb}}{N_{COIL}} \times V_{FHA}\right)^2}{R_{SLVb}} \tag{10}$$

As is understood from the formula (10), even when the surface $R_{SLVb}$ is high, by increasing $H_{SLVb}$, the heat quantity can be increased.

Figure 11:
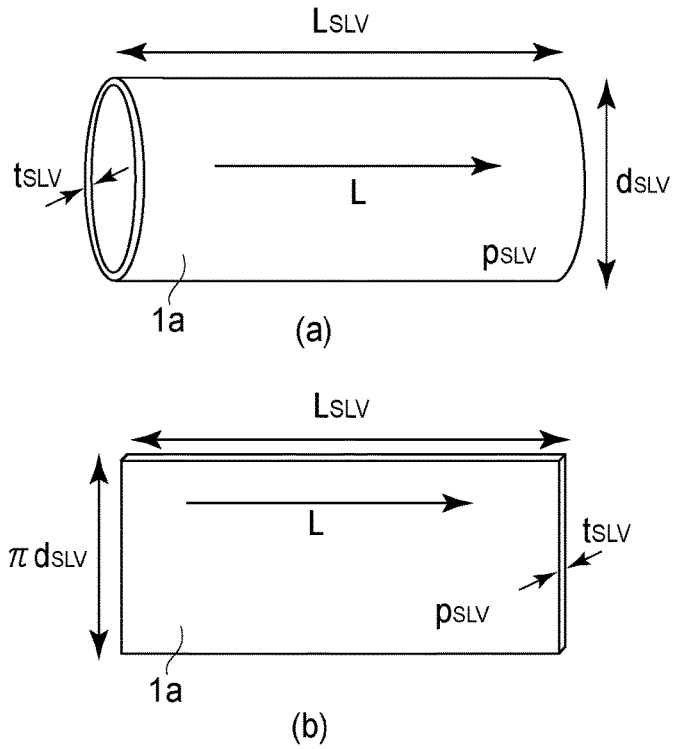
In FIG. 11, (a) and (b) are schematic views showing a shape of the heat generating layer and a calculating method of a resistance of the heat generating layer with respect to the generatrix direction.

In (a) of FIG. 11, a shape of the heat generating layer 1*a* and a calculating method of the resistance $R_{SLVb}$ with respect to the generatrix direction of the heat generating layer 1*a* are shown. The heat generating layer 1*a* is $L_{SLV}$ (m) in length with respect to the generatrix direction of the heat generating layer 1*a*, $d_{SLV}$ (m) in diameter, $t_{SLV}$ (m) in thickness and $\rho_{SLV}$ (Ωm) in volume resistivity. Then, the electric resistance when the cylinder is cut and developed as shown in (b) of FIG. 11 and then the current is caused to flow in an arrow L direction (generatrix direction of the heat generating layer 1*a*) is represented by the following formula (11).

$$R_{SLVb} = \frac{\rho_{SLV} \times L_{SLV}}{t_{SLV} \times \pi d_{SLV}} \tag{11}$$

Here, a calculation example in the case where the volume resistivity of the heat generating layer 1*a* is about $5.0\times10^{-4}$ Ωm will be described.

TABLE 4

| Item | Symbol | Numerical value | Unit |
|---|---|---|---|
| HWN*1 | $R_{SLVa}$ | 55 | — |
| GHQ*2 | $P_{SLVa}$ | 980.7 | W |

*1"HWN" is the helical winding number.
*2"GHQ" is the generated heat quantity.

The helical winding number of the electrode layer 1*b* is made 55, so that it is estimated that the heat quantity which is the same level as that in the case where the stainless steel is used as the material of the heat generating layer 1*a* in the conventional type can be obtained. In actually, as the material of the heat generating layer 1*a*, the electroconductive polyimide of about $5.0\times10^{-4}$ Ωm in volume resistivity was employed, and heat generation of the film 1 formed as the electrode layer 1*b* by winding the wire of SUS 304 in the helical shape by 55 turns was checked. Then, it was confirmed that the entirety of the film 1 was able to be increased in temperature at a sufficient speed.

The calculation under the assumption that the commercial power source voltage is 100 V and the experimental results were described above. In the case where the commercial power source voltage is 200 V, for example, the voltage $V_{FHA}$ of the primary-side coil is 200/100 times, i.e., 2 times. In this case, by changing the helical winding number of the electrode layer 1*b* to 55/2=27.5 turns, the substantially same generated heat quantity can be obtained without changing the constitution of the primary-side coil between the commercial power source voltages of 100 V and 200 V. That is, only be exchanging (replacing) the film 1, without exchanging the parts such as the core 2, the same temperature control can be effected so as to meet both of the cases of the commercial power source voltages of 100 V and 200 V.

[Embodiment 2]

This embodiment is an embodiment in which a positional relationship between a maximum image forming region and longitudinal end portions (one end portion and the other end portion) of an electrode layer and in which a desired region can be uniformly heated. In this embodiment, the same constitution as that of Embodiment 1 is employed except that a longitudinal width of the electrode layer 1*b* is defined.

The longitudinal width of the electrode layer 1*b* formed in the helical shape is set in the following manner. That is, the helically shaped electrode layer 1*b* is formed so that when a point corresponding to a position on the electrode layer 1*b* apparently wound from a helical shape starting point on the (adjacent) electrode layer 1*b* so as to provide a shortest distance-therebetween at a longitudinal end portion of the electrode layer 1*b* is defined as a reference point, a width between reference points at both longitudinal end portions is at least (equal to or more than) a width of the maximum image forming region.

Figure 26:
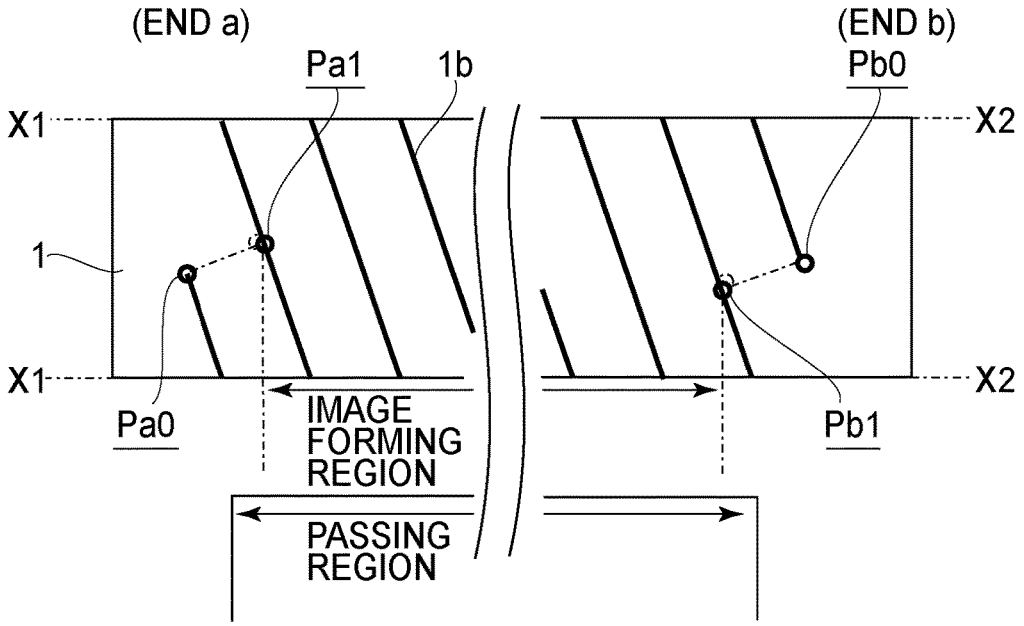
FIG. 26 is a schematic view showing a positional relationship with respect to a longitudinal direction of a film in Embodiment 2.

FIG. 26 is a schematic view showing a positional relationship between the maximum image forming region and the electrode layer 1*b*. FIG. 26 schematically shows a state of the electrode layer 1*b* when the fixing film 1 is cut and developed along rectilinear lines X1-X2 with respect to the generatrix direction of the heat generating layer 1*a*.

As shown in FIG. 26, at a longitudinal end portion (one end portion) a of the electrode layer 1*b*, a reference point Pa1 as an electrode layer point corresponding to a point on the electrode layer 1*b* apparently wound from the helical shape starting point Pa0 on the (adjacent) electrode layer 1*b* so as to provide the shortest distance therebetween is set. The point Pa1 is the point moved perpendicular from the point Pa0 thereto (shortest distance). That is, the point Pa1 is the closest point, to the point Pa0, of points on adjacent portions of the electrode layer 1*b* with respect to the generatrix direction of the heat generating layer 1*a*. Also at another longitudinal end portion (the other end portion) b, points Pb0 and Pb1 are similarly set. The helical shaped electrode layer 1*b* is constituted so that a width between the points Pa1 and Pb1 set as described above is not less than the width of the maximum image forming region.

Incidentally, the maximum image forming region is a printing region of a maximum width toner image formable on the recording material at the image forming portion and refers to a region obtained by subtracting a margin from a maximum width of the recording material which is capable of passing through the fixing device. In this embodiment, the material image forming region is 208 mm obtained by subtracting 8 mm, which is the sum of the margin of 4 mm in Comparison Example side and the margin of 4 mm in the other end side, from the maximum width of 216 mm of the recording material.

As described in Embodiment 1, in the case where the electroconductive polyimide of about $5.0\times10^{-4}$ Ωm is used as the material of the heat generating layer and the SUS 304 wire is used as the electrode layer, a desired amount of the heat quantity can be obtained by winding the electrode layer around the heat generating layer by 55 turns. In the case where the electrode layer is wound helically around the heat generating layer by 55 turns and the width between Pa1 and Pb1 is not less than the width (208 mm) of the maximum image forming region, a pitch of the helical shape (longitudinal interval) is about 4 mm. Further, in the case where the film of 30 mm in inner diameter is used, an inclination angle of the electrode layer is about 6° from a circumferential direction in a state in which the electrode layer is cut and developed along the longitudinal direction.

In Embodiment 1, for convenience, description was made such that the current roughly flows in the generatrix direction, but strictly, it would be considered that the current flows in a direction (Pa0-Pa1 direction in FIG. 26) in which adjacent portions of the electrode layer provide the shortest distance. In the case where the electrode layer is wound around the heat generating layer by 55 turns as described above, the current flows in a direction inclined from a generatrix by about 6°.

Figure 27:
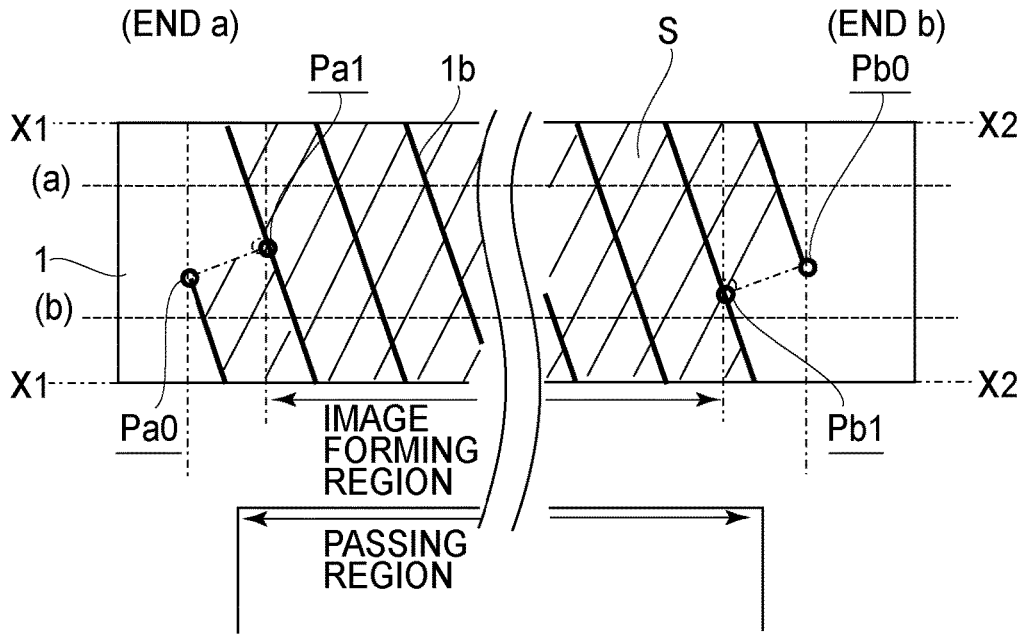
FIG. 27 is a schematic view showing a heat generating region with respect to the longitudinal direction of the film in Embodiment 2.

FIG. 27 is a schematic view showing a heat generation distribution with respect to the longitudinal direction of the film.

The current flowing through the heat generating layer of the film flows between adjacent portions of the electrode layer in a shortest distance, and therefore a portion, indicated as a hatched line portion S, where adjacent electrode layer portions are connected with each other in the shortest distance generates heat. Accordingly, a region inside the points Pa1 and Pb1 is a region where the heat generates uniformly with respect to the circumferential direction. That is, in regions outside the points Pa0 and Pb0, i.e., in end portion-side regions, the current does not flow and therefore heat does not generate. Further, in a region between the points Pa0 and Pa1 and a region between the points Pb0 and Pb1, there is a portion where the current does not flow and heat does not generate depending on a circumferential place, so that heat generation non-uniformity occurs with respect to the circumferential direction. On the other hand, in the region inside the points Pa1 and Pb1, the current flows and heat generates at all of points with respect to the circumferential direction.

Figure 28:
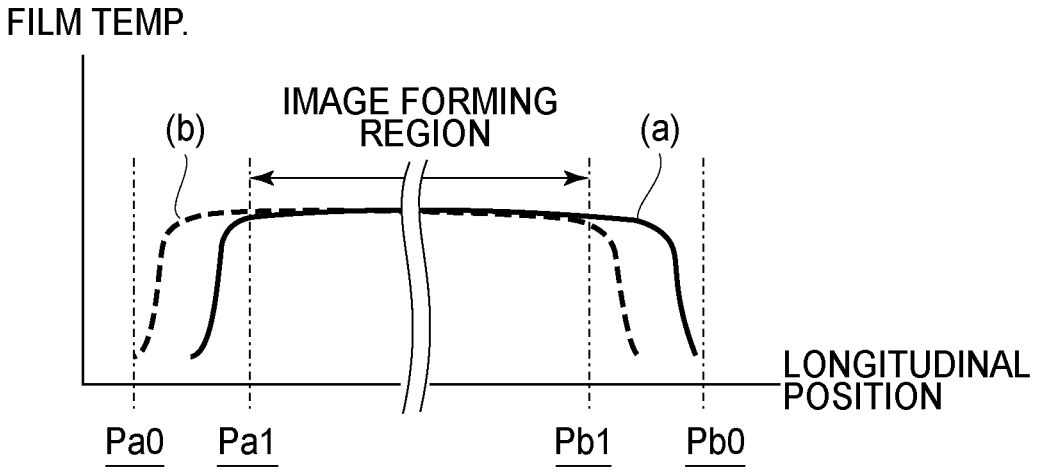
FIG. 28 is a graph showing a temperature distribution of the film with respect to the longitudinal direction in Embodiment 2.

FIG. 28 is a graph showing a longitudinal temperature distribution at portions indicated by broken lines (a) and (b) in FIG. 27. As shown in FIG. 28, temperature distribution curves (a) and (b) are different in temperature with respect to the longitudinal direction, and the curve (a) shifts toward a right-hand side relative to the curve (b).

Thus, the film 1 is different in longitudinal temperature distribution depending on the circumferential place. Here, the region inside the points Pa1 and Pb1 is a region in which heat generates at any portion and the temperature is constant. Accordingly, as in this embodiment, by employing a constitution in which the image forming region is provided between the points Pa1 and Pb1, a uniform temperature can be maintained to image end portions, so that improper fixing can be suppressed. In actuality, when a fixed image was checked using the film in this embodiment, a good image can be obtained without causing the improper fixing.

In this embodiment, the embodiment in which the width between the reference points Pa1 and Pb1 on the electrode layer 1*b* is substantially the same as the width of the maximum image forming region was described, but a constitution in which the width between the reference points Pa1 and Pb1 is broader than the width of the maximum image forming region may also be employed. For example, a constitution in which the width of the electrode layer 1*b* between the points Pa0 and Pb0 is 230 mm and the width between the points Pa1 and Pb1 is 222 mm which is larger than the image forming region width of 208 mm may also be employed. By employing such a constitution, tolerance during manufacturing and positional deviation during rotational drive can be allowed.

In the constitution of this embodiment, the heat generation width is set by providing the electrode layer on the heat generating layer of the film and is set by the electrode layer. For this reason, by suppressing heat generation of unnecessary portions at layer end portions, heat can be generated at a necessary portion, so that it becomes possible to suppress non-sheet-passing portion temperature rise or the like. For example, in the case where SUS 304 in the conventional type is used as the heat generating layer of the film, "heat generation width"="film width" and therefore heat generation extends to the unnecessary portions at the longitudinal end portions. As a result, in the case where further speed-up of the apparatus is intended to be realized, suppression of the non-sheet-passing portion temperature rise is a problem. On the other hand, in this embodiment, a constitution of "heat generation width"<"film width" can be employed, and therefore heat generation at the non-sheet-passing portions which are the unnecessary portions can be suppressed and it becomes possible to suppress the non-sheet-passing portion temperature rise.

[Modified Embodiment]

Figure 29:
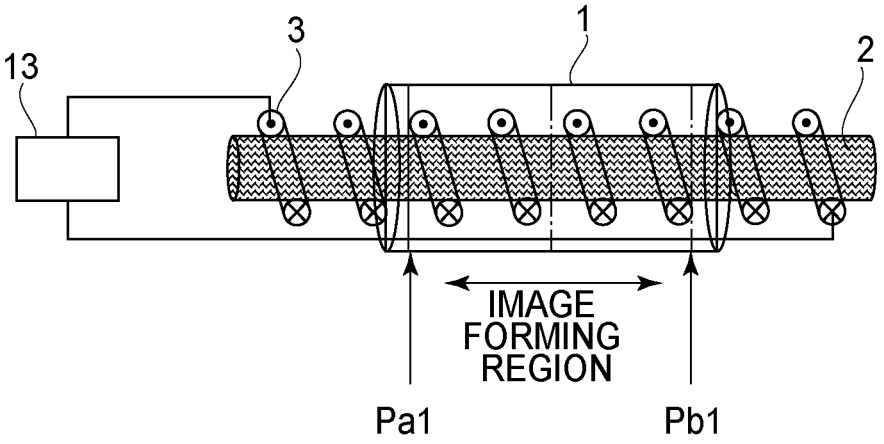
FIG. 29 is a schematic view for illustrating a structure of a coil and a core of a fixing device in Embodiment 2.

FIG. 29 is a schematic view showing a positional relationship among the film 1, the coil 3 and the core 2 is Modified Embodiment of Embodiment 2.

The coil 3 is helically wound around the core 2 so that a helical axis is parallel to the generatrix direction of the rotatable member. Both end portions of the core 2 and the helical-shaped portion of the coil 3 extends to outsides of both end portions of Pa1 and Pb1 of the rotatable member with respect to the generatrix direction (In the figure, the end portions of the core 2 and the helical-shaped portion of the coil 3 extend to the outside of the film 1). By employing such a constitution, magnetic flux can be efficiently induced into the electrode layer of the film.

Figure 20:
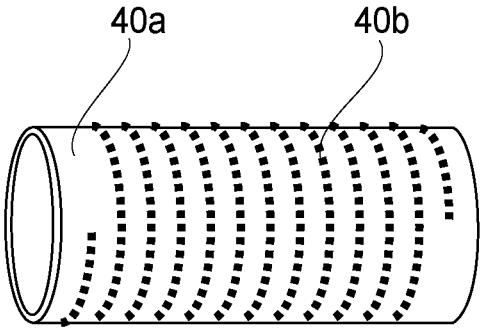
In FIG. 20, (a) to (c) are schematic views for illustrating a structure of a film in Embodiment 7.
Figure 20:
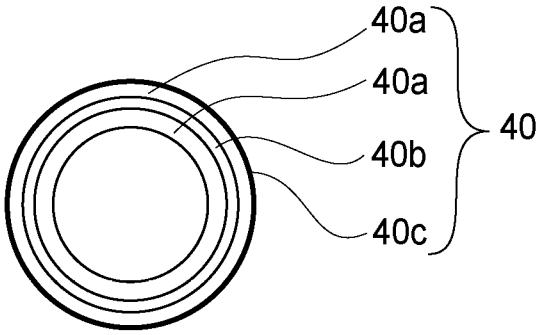
Figure 20:
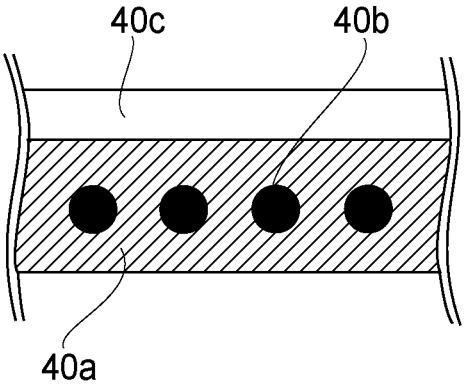

In FIG. 20, (a) is a schematic view showing generating magnetic flux 221. As is understood from the figure, the magnetic flux passing through a central portion of the core 2 passes in substantially parallel to the surface of the film 1. On the other hand, as regards the magnetic flux coming out from one end portion of the core 2, due to a difference in permeability between the core 2 and a core outside portion, a component extending perpendicularly to the surface of the film increases. Then, the magnetic flux 221 passes through an outside space of the film 1 and flows into the other end portion of the core 2.

The generating magnetic flux also includes a component passing through a space between the film 1 and the coil 3 and flowing into the other end portion of the core 2. This component of the magnetic flux is opposite in direction from the magnetic flux passing through the inside of the core 2, and therefore the magnetic flux components are cancelled by each other inside the film 1, so that the magnetic flux passing through the inside of the core 2 decreases. That is, of the magnetic flux generated by the high-frequency current supplied from the power source to the coil, the magnetic flux component contributing to the heat generation of the film decreases. Thus, the magnetic flux component passing through the space between the film and the coil lowers heat generation efficiency. The heat generation efficiency refers to a proportion of a heat quantity generated by the film to electric power supplied to the power source, and can be defined by an amount of the magnetic flux contributing to the heat generation of the film as described above.

In this embodiment, by setting the lengths of the coil 3 and the core 2 so as to be longer than the length of the electrode layer (P1-P1), the perpendicular component of the magnetic flux 221 extends outside the film 1 (Pa1-Pb1). For that reason, in the region between P1*a* and P1*b*, the magnetic flux component passing through the space between the film and the coil can be decreased, and therefore a decrease in magnetic flux component contributing to the heat generation in the region between P1*a* and P1*b* is suppressed, so that it is possible to suppress a lowering in heat generation efficiency.

Figure 30:
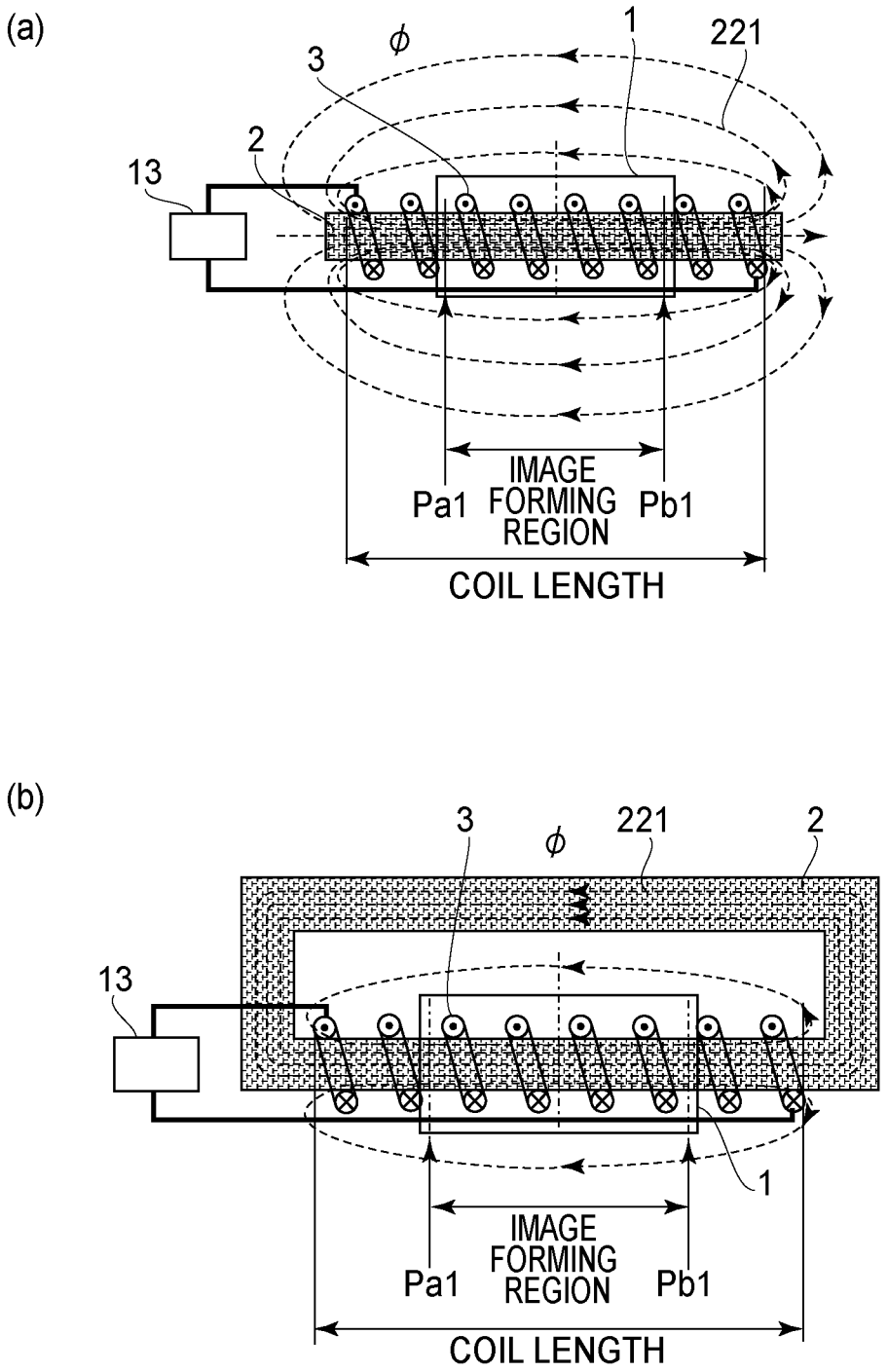
In FIG. 30, (a) and (b) are schematic views for illustrating magnetic flux formed by the fixing device in Embodiment 2.

In FIG. 30, (b) is a schematic view showing the magnetic flux 221 when a cyclic core is used in place of a non-endless core in (a) of FIG. 30. In the case of a constitution using the cyclic core as shown in the figure, the magnetic flux passing through the core forms a closed loop, and therefore the above-described magnetic flux component passing through the space between the film and the core can be further decreased, so that the lowering in heat generation efficiency can be further suppressed.

[Embodiment 3]

In this embodiment, a relationship between a resistance value and a heat quantity of the electrode layer 1*b* and the heat generating layer 1*a* of the fixing film 1 is defined, so that a difference in temperature rising speed between the electrode layer 1*b* and the heat generating layer 1*a* can be suppressed to a small value. In this embodiment, constitutions other than the fixing film 1 are the same as those in Embodiment 1, and therefore will be omitted from description.

In the conventional electromagnetic induction heating type disclosed in JP-A 2014-26267, the resistance value of the fixing film heat generating layer 1*a* is set at a sufficiently low value, and therefore the circumferential current flows through the heat generating layer 1*a* in the circumferential direction and generates heat. On the other hand, the resistance value of the fixing film heat generating layer 1*a* described in Embodiment 1 is set at a high value, and therefore the circumferential current with respect to the circumferential direction does not flow little at a commercial power source level. However, the electrode layer 1*b* contacting the heat generating layer 1*a* is provided, and the resistance value of the electrode layer 1*b* is set at a sufficiently low value. Further, the electrode layer 1*b* is formed in the helical shape along the generatrix direction of the heat generating layer 1*a*. In such a constitution, a current with respect to the fixing film axial direction flows through the heat generating layer 1*a* and generates heat.

Here, the case where the volume resistivity of the heat generating layer 1*a* is substantially equal to that of the electrode layer 1*b*, i.e., the case where the resistance of the heat generating layer 1*a* is sufficiently low also in the constitution including the helical-shaped electrode layer 1*b* will be considered. This case corresponds to the case where the resistance value of the heat generating layer 1*a* in the conventional type disclosed in JP-A 2014-26267 is low. In such a case, it would be considered that the circumferential current with respect to the circumferential direction flows through also the electrode layer 1*b* via the heat generating layer 1*a* and generates heat. That is, when the resistance of the heat generating layer 1*a* is gradually decreased, it would be considered that the heat generation type finally approaches the conventional heat generation type.

Based on this consideration, when a relationship of heat generation between the electrode layer resistance and the heat generating layer resistance is studied, the following phenomena were observed.

COMPARISON EXAMPLE 1

A cylindrical fixing film 1 including a heat generating layer 1*a* and an electrode layer 1*b* helically formed on the heat generating layer 1*a* was prepared, and a state of temperature rise was observed. As the heat generating layer 1*a*, a cylindrical polyimide film of 30 mm in inner diameter, 220 mm in longitudinal length and 60 μm in thickness was used. In order to cause the polyimide film to function as a layer which generates heat, there is a need to impart electroconductivity to the polyimide film. Therefore, a value of the polyimide film was adjusted to about $1.0\times10^{-2}$ Ωm by dispersing an electroconductive filler into the polyimide recording material. For measurement of the volume resistivity, a resistivity meter ("Loresta-GP", manufactured by Mitsubishi Chemical Analytech Co., Ltd.) was used. The helical-shaped electrode layer 1*b* was formed of nickel of about $7.0\times10^{-8}$ in volume resistivity through electroless plating. The electrode layer 2*b* was formed in the helical shape of 2.0 mm in electrode layer width and 20 μm in thickness, and the width number (number of turns) was 55 (turns), i.e., the helical shape was 2 mm in interval.

The thus-prepared fixing film 1 in Comparison Example 1 was heated by the electromagnetic induction heating type described in Embodiment 1, and a temperature rising state was observed through a thermo-viewer. In the case of Comparison Example 1, the temperature rise of the electrode layer 1*b* was observed little, and the temperature rise of the heat generating layer 1*a* was observed.

COMPARISON EXAMPLE 2

Comparison Example 2 is the case where the volume resistivity of the electroconductive polyimide film as the heat generating layer 1*a* is lowered. As the heat generating layer 1*a*, the electroconductive polyimide film of about $1.0\times10^{-3}$ in volume resistivity was used. Other constitutions are the same as those in Comparison Example 1. In the case of Comparison Example 2, in addition to the heat generating layer 1*a*, the temperature rise was observed also in the electrode layer 1*b*. However, the temperature rising speed was faster in the heat generating layer 1*a* than in the electrode layer 1*b*.

COMPARISON EXAMPLE 3

Comparison Example 3 is the case where the volume resistivity of the electroconductive polyimide film as the heat generating layer 1*a* is further lowered. As the heat generating layer 1*a*, the electroconductive polyimide film of about $1.0\times10^{-4}$ in volume resistivity was used. Other constitutions are the same as those in Comparison Example 1. Also in the case of Comparison Example 3, in addition to the heat generating layer 1*a*, the temperature rise in the electrode layer 1*b* was observed. Further, a result that the temperature rising speed was faster in the electrode layer 1*b* than in the heat generating layer 1*a* was obtained.

If the consideration that the heat generation type gradually approaches the conventional heat generation type with a decreasing resistance of the heat generating layer 1*a* is correct, the temperature rising speed of the electrode layer 1*b* cannot be faster (higher) than that of the heat generating layer 1*a*. Therefore, a manner of flow of the current in the constitution including the helical-shaped electrode layer 1*b* was further considered.

Figure 31:
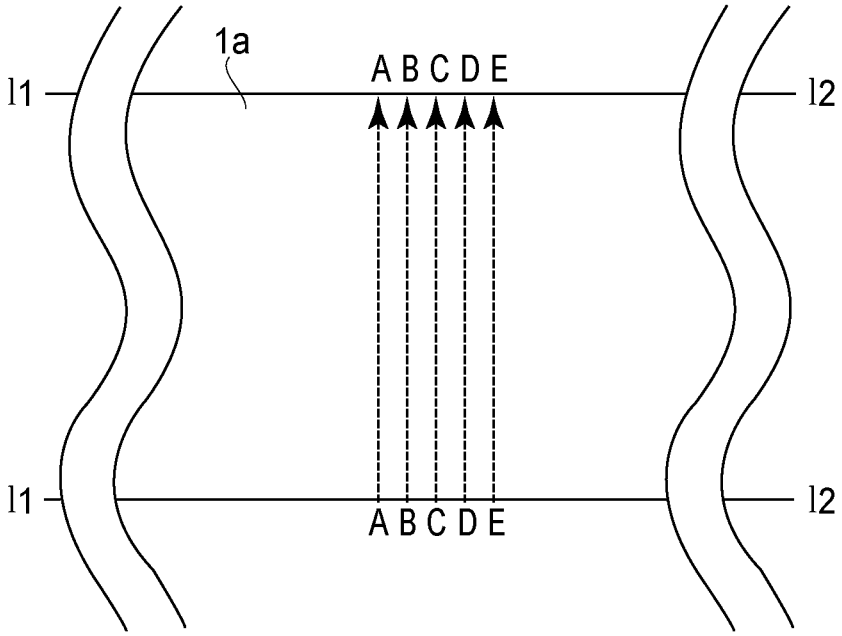
FIG. 31 is a development of a fixing film including no electrode layer in Embodiment 3.

FIG. 31 is a development of the fixing film 1 including no electrode layer 1*b*. Magnetic lines of force generated by the core 2 provided inside the fixing film 1 extend in parallel to the rotation axis of the fixing film 1. An electromotive force generates in the circumferential direction so as to cancel the magnetic lines of force. In the case where there is no electrode layer 1*b* and only the heat generating layer 1*a* exists, a resistance distribution uniform with respect to the circumferential direction is obtained. Further, in the case where the resistance value of the heat generating layer 1*a* is sufficiently low, the current flows in the circumferential direction in a large amount, and therefore a sufficient degree of heat generation can be obtained. In the development view, A, B, C, D and E represent the same point on the cut and developed fixing film 1. Flow of the circumferential current means that a flow of the current starting from A in a lower side of FIG. 31 reaches A in an upper side in FIG. 31. In the case of a uniform resistor, the current flows in the circumferential direction, and therefore the current flows in a substantially perpendicular direction as indicated by a broken-line arrow in FIG. 31. This is also true for B, C, D and E.

Figure 32:
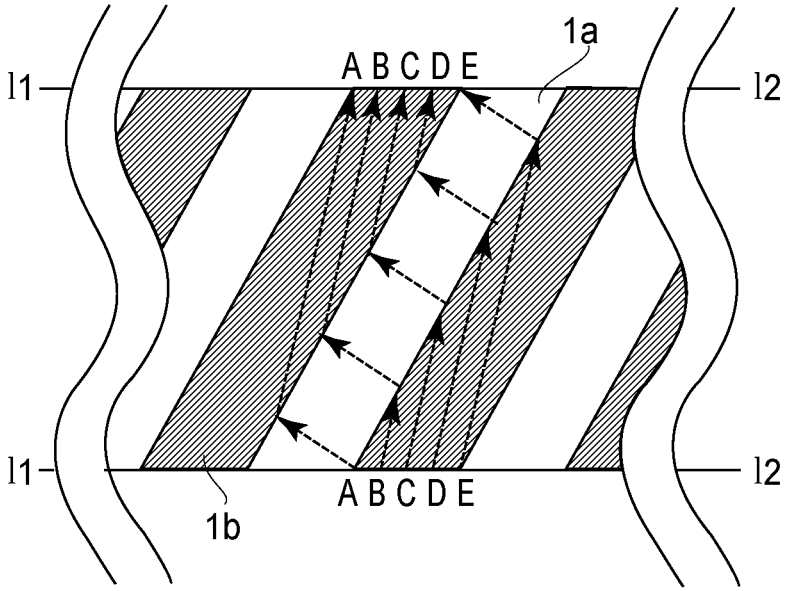
FIG. 32 is a development of a fixing film including an electrode layer in Embodiment 3.

FIG. 32 is a development of the fixing film 1 including the helical-shaped electrode layer 1*b*. In FIG. 32, a hatched portion represents the electrode layer 1*b*. The resistance value of the electrode layer 1*b* is lower than the resistance value of the heat generating layer 1*a*, and therefore a non-uniform resistance distribution is obtained with respect to the circumferential direction. Similarly as in the case of FIG. 31, the magnetic lines of force generated by the core 2 extend in parallel to the rotation axis of the fixing film 1 and the electromotive force generates in the circumferential direction so as to cancel the magnetic lines of force. However, in the case where the circumferential current flowing in a direction perpendicular to the rotation axis of the film is considered, the resistance of the heat generating layer 1*a* is high and therefore an amount of the current is very small, so that heat generation in the heat generating layer 1*a* and the electrode layer 1*b* ought to occur little.

However, the current does not always flow in the same direction as the generated electromotive force. A current path ought to be path in which a resistance value is a minimum when the current path forms a loop. That is, it would be considered that the flow of the current starting from A in a lower side of FIG. 32 forms, as the path in which the resistance value is the minimum, a path in which the current flows substantially in the axial direction in the heat generating layer 1*a* and then flows substantially in the circumferential direction in the electrode layer 1*b* as indicated by broken-line arrows in FIG. 32. This is also true for B, C, D and E.

Figure 33:
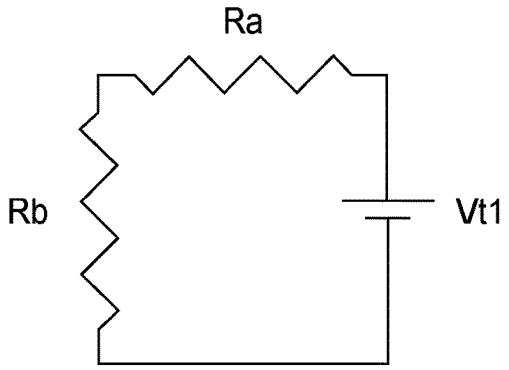
FIG. 33 is a schematic model view showing an electric circuit of the fixing film including the electrode layer in Embodiment 3.

An amount of the current corresponding to one full circumference of the helical-shaped electrode layer 1*b* can be regarded as the sum of current amounts from the path A to the path E. Further, the sum of the current amounts from the path A to the path E is equal to an amount of the current flowing in the heat generating layer 1*a* between adjacent electrode layer portions. That is, in the case where as regards one full circumference of the helical-shaped electrode layer 1*b*, a circumferential resistance is Rb, a resistance of the heat generating layer 1*a* between adjacent electrode layer portions is Ra and an electromotive force generating in the electrode layer 1*b* through one full circumference is Vt1, an electric circuit thereof can be modeled as a series circuit of Ra and Rb as shown in FIG. 33.

A current value It1 generated by the electromotive force Vt1 is Vt1/(Ra+Rb), a partial electromotive force of the heat generating layer 1*a* is Vt1×Ra/(Ra+Rb), and a partial electromotive force of the electrode layer 1*b* is Vt1×Rb/(Ra+Rb). Therefore, electric power consumption in the heat generating layer 1*a* is $(Vt1/(Ra+Rb))^2\times Ra$, and electric power consumption in the electrode layer 1*b* is $(Vt1/(Ra+Rb))^2\times Rb$. Accordingly, in the case of Rb<Ra, the electric power consumption in the heat generating layer 1*a* becomes larger, so that the heat generation principally occurs in the heat generating layer 1*a*. This would be considered as being the cases of Comparison Examples 1 and 2. On the other hand, in the case of Rb>Ra, the electric power consumption in the electrode layer 1*b* becomes larger, so that the heat generation principally occurs in the electrode layer 1*b*. This would be considered as being the case of Comparison Example 3. Therefore, a resistance value between both ends of the electrode layer 1*b* wound around the heat generating layer 1*a* by 55 turns and a resistance value between both ends of the heat generating layer 1*a* with respect to the axial direction were measured. For measurement of the resistance, a digital multi-meter ("Model 189", manufactured by Fuke Corp.) was used. The resistance value between the both ends of the electrode layer 1*b* was measured by abutting measuring terminals of the digital multi-meter against the both ends of the electrode layer 1*b*. The resistance value between the both ends of the heat generating layer 1*a* with respect to the axial direction was measured by applying a copper foil tape onto the heat generating layer 1*a* at both end portions and then by abutting the measuring terminals of the digital multi-meter against the copper foil tape at the both end portions of the heat generating layer 1*a*. Measurement results are shown in Table 5, in which in Comparison Examples 1 and 2, the heat generating layer resistance was larger, and in Comparison Example 3, the electrode layer resistance was larger.

TABLE 5

| COMP. EX. | ELRV*1 (Ω) | HGLRV*2 (Ω) |
|---|---|---|
| 1 | 9.1 | 390 |
| 2 | 9.1 | 39.5 |
| 3 | 9.1 | 4.1 |

*1"ELRV" is the electrode layer resistance value.
*2"HGLRV" is the heat generating layer resistance value.

From the above results, it turned out that in the case of the fixing film 1 including the helical-shaped electrode layer 1*b*, even when the volume resistivity of the electrode layer 1*b* is lower than the volume resistivity of the heat generating layer 1*a*, the electrode layer 1*b* generates heat and can be high in temperature rising speed.

In Comparison Example 2, the temperature rising speed of the heat generating layer 1*a* was higher, and in Comparison Example 3, the temperature rising speed of the electrode layer 1*b* was higher. A difference in these two Comparison Examples is the volume resistivity of the heat generating layer 1*a*. Therefore, when the volume resistivity was adjusted so that the temperature rising speeds were substantially equal to each other, the temperature rising speeds were able to be made substantially the same value of about $3.2\times10^{-4}$.

Next, a condition in which the temperature rising speeds of the electrode layer 1*b* and the heat generating layer 1*a* are equal to each other will be considered. The temperature rising speed is determined by a heat generation amount and thermal capacity. In the case where the temperature rising speed is T, the heat generation amount is W and the thermal capacity is C, a relationship of T=W/C holds. The heat generation amount can be considered as being equal to generated electric power. That is, the heat generation amount in the heat generating layer 1*a* is $(Vt\mathbf{1}/(Ra+Rb))^2\times Ra$, and the heat generation amount in the electrode layer 1*b* is $(Vt\mathbf{1}/(Ra+Rb))^2\times Rb$. In the case where the thermal capacitance of the heat generating layer 1*a* is Ca and the thermal capacitance of the electrode layer 1*b* is Cb, a temperature rising speed Ta in the heat generating layer 1*a* is $(Vt\mathbf{1}/(Ra+Rb))^2\times(Ra/Ca)$ and a temperature rising speed Tb in the electrode layer 1*b* is $(Vt\mathbf{1}/(Ra+Rb))^2\times(Pb/Cb)$. Therefore, the condition for Ta=Tb is Ra/Ca=Rb/Cb. That is, it would be considered that under a condition that a value of (Ra/Ca)/(Rb/Cb) is 1, the two temperature rising speeds are equal to each other and uniform heat generation occurs.

The resistance value Rb through one full circumference of the helical-shaped electrode layer 1*b* can be obtained by dividing the above-measured resistance value between the both ends of the electrode layer 1*b* y the winding number. The resistance value Rb of about 0.165Ω can be obtained by dividing 9.1Ω by 55.

Figure 34:
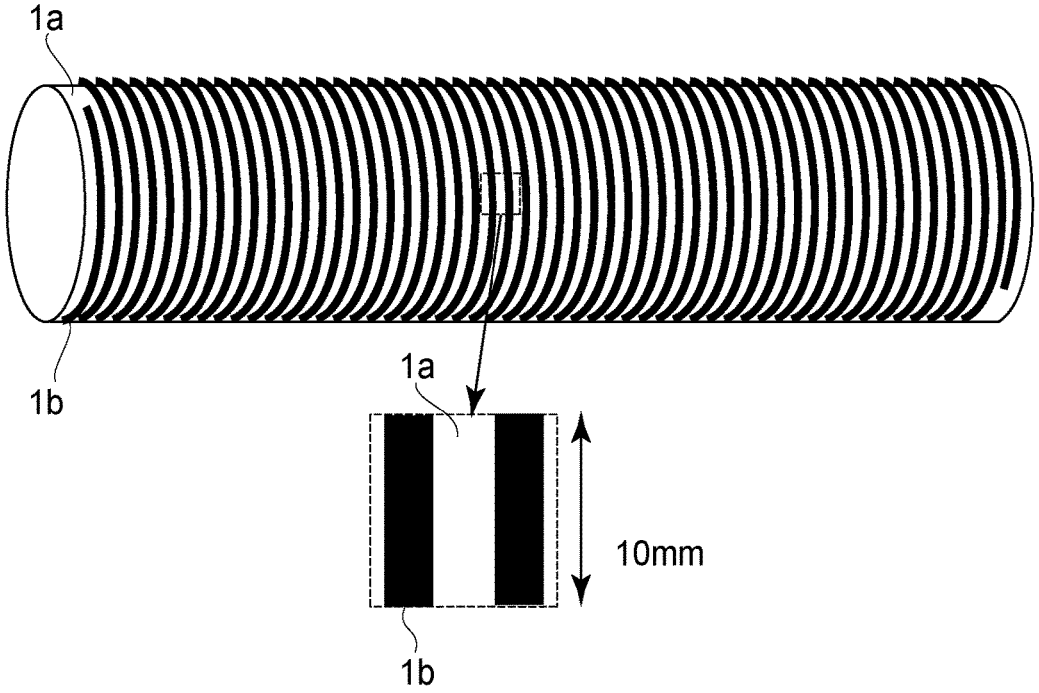
FIG. 34 is a schematic view for illustrating a measuring method of a resistance of a heat generating layer between adjacent electrode layers in Embodiment 3.

Then, the resistance value Ra of a heat generating portion of the heat generating layer 1*a* corresponding to one full circumference of the helical-shaped electrode layer 1*b* is obtained from measurement. The fixing film was cut in a width of 10 mm as shown in FIG. 34, and the resistance value between the electrode layers 1*b* and was converted into a value corresponding to one full circumference of the helical-shaped portion, so that the resistance value Ra was obtained. Here, the reason why the resistance value was measured after the fixing film was cut in a small width of 10 mm is that the resistance value was excessively small when the resistance value was measured for the one full circumference of the helical-shaped portion and therefore a measurement result was unstable. The width is not limited to 10 mm. When the resistance of the fixing film of 10 mm in width was measured, the resistance value was 1.5Ω, and therefore the resistance value Pa corresponding to one full circumference of the helical-shaped portion ca be estimated as about 0.159Ω.

In the case where specific heat is c and a weight is m, the thermal capacity can be represented by c×m. The weight can be obtained from mass density and a volume, and therefore when the shape, the mass density and the specific heat of the heat generating portion are known, the thermal capacity can be estimated. When the mass density and the specific heat were measured, the electrode layer 1*b* was about 440 J/(kg·K) in specific heat and about $8.9\times10^{-6}$ kg/mm$^3$ in mass density. For measurement of the mass density, an automatic dry type density meter ("Accupyc 1330", manufactured by Shimadzu Corp.) was used. For measurement of the specific heat, a differential scanning calorimeter ("DSC8000", manufactured by Perkin Elmer Co., Ltd.) was used. Similarly, when the mass density and the specific heat of the heat generating layer 1*a* were measured, the heat generating layer 1*a* was about 900 J/(kg·K) in specific heat and about $2.0\times10^{-6}$ kg/mm$^3$ in mass density.

The shape of the electrode layer 1*b* is 2.0 mm in electrode layer width and 20 μm in thickness. When thermal capacity Cb of the electrode layer 1*b* for one full circumference of the helical-shaped portion was estimated from the volume obtained from (electrode layer width)×(thickness)×(length corresponding to one full circumference of electrode layer) and the measured specific heat and mass density, a result of about $1.48\times10^{-2}$ J/K was obtained.

Next, the thermal capacity of the heat generating layer 1*a* will be estimated.

Figure 35:
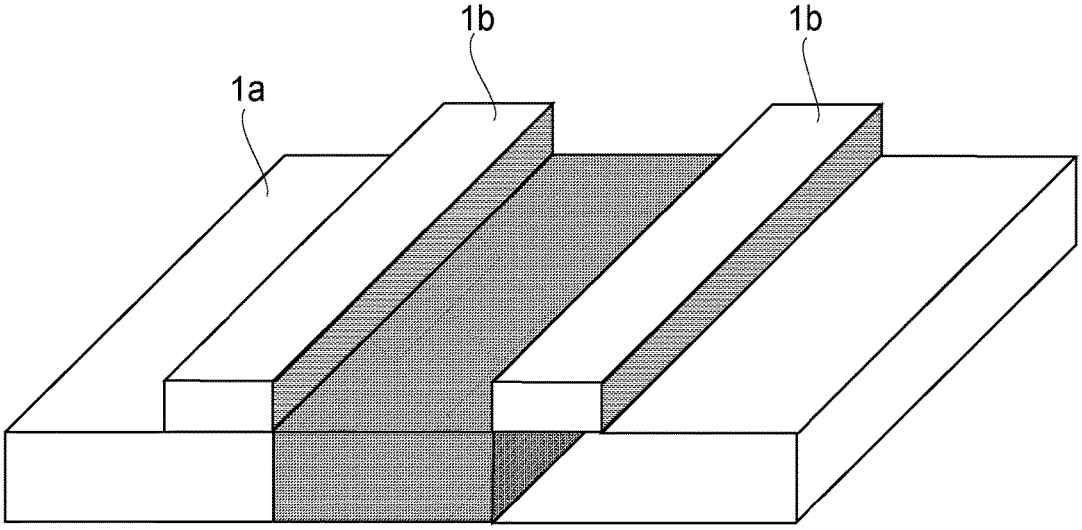
FIG. 35 is a perspective view of the fixing film including the electrode layer in Embodiment 3.
Figure 36:
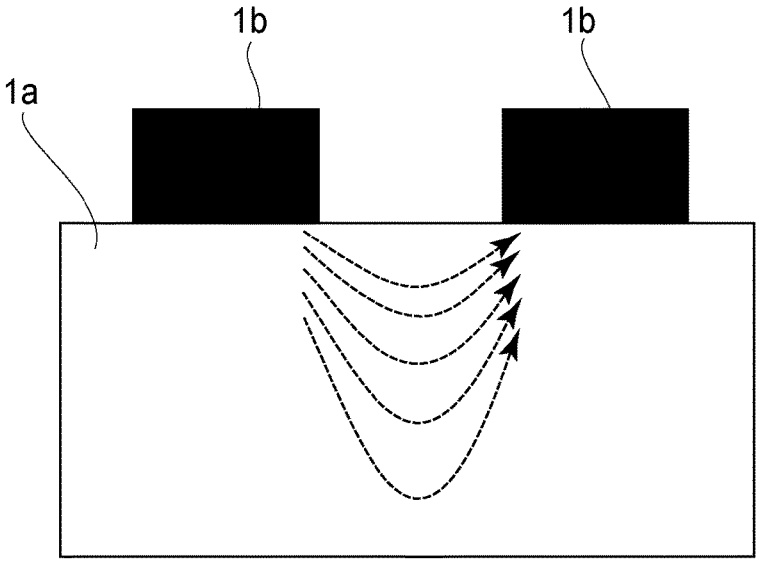
FIG. 36 is a sectional view, of the fixing film in Embodiment 3, for illustrating a current path between the adjacent electrode layers.

FIG. 35 is a schematic perspective view of the fixing film 1 in cross section. In the heat generating layer 1*a*, assuming that the current flows in an entire region of a rectangular parallelopiped shape as indicated by a shade portion of the perspective view, the volume resistivity is about $3.2\times10^{-4}$ Ωm, and therefore a resistance value calculated from the shape ((electrode layer width)×(thickness)×(length corresponding to one full circumference of electrode layer)) is about 0.107Ω. However, a value obtained from a measurement result of an interelectrode layer resistance was about 0.159Ω which was somewhat large value. This would be considered because the current flowing through the inside of the heat generating layer 1*a* does not flow in an entire region of the heat generating layer 1*a* with respect to the thickness direction, but flows as indicated by broken-line arrows as shown in FIG. 36 in the case where the fixing film cross-section is considered. Therefore, as the volume in the case where the thermal capacity is estimated, not a volume calculated from (electrode layer width)×(thickness)×(length corresponding to one full circumference of electrode layer), a volume such that it provides the resistance value measured between the electrode layers may only be required to be assumed. Therefore, a value obtained by multiplying a volume value obtained by (electrode layer width)×(heat generating layer thickness)×(length corresponding to one full circumference of electrode layer) by (resistance value obtained from interelectrode layer resistance measurement)/(resistance value estimated from volume resistivity) as a correction coefficient is used as the volume. That is, in this time, 0.107/0.159 is a correction value. When the thermal capacitance of the electrode layer 1*b* corresponding to the one full circumference of the helical-shaped portion was estimated from the corrected volume and the measured specific heat and mass density, a value of about $1.37\times10^{-2}$ J/K was obtained.

From the above estimated value, when (Ra/Ca)/(Rb/Cb) is calculated, a value of 1.04 is obtained. That is, it was able to be confirmed that in a condition that the value of (Ra/Ca)/(Rb/Cb) is almost 1, the temperature rising speed was substantially the same and that the heat generated uniformly. Then, when the fixed image was checked using the fixing film in the condition in which the value of (Ra/Ca)/(Rb/Cb) was 1.04, it was able to obtain a good fixed image with no non-uniformity of the fixing property and no uneven glossiness.

If the good fixed image can be obtained, even when there is a temperature rising speed difference to some extent, fixing non-uniformity is allowed. Therefore, in order to check that the fixing non-uniformity is allowed to what degree, the volume resistivity of the electroconductive polyimide as the heat generating layer 1*a* was changed, and an image in the case where the value of (Ra/Ca)/(Rb/Cb) was different was evaluated. A result is shown in Table 6.

TABLE 6

| EPVR*1 ($\times 10^{-4}$ Ωm) | (Ra/Ca)/(Rb/Cb) | FNE*2 |
|---|---|---|
| 1.1 | 0.360 | x |
| 1.2 | 0.388 | Δ |
| 1.5 | 0.485 | oΔ |
| 2.0 | 0.658 | o |
| 3.2 | 1.04 | o |
| 4.7 | 1.52 | o |
| 6.1 | 2.01 | oΔ |
| 7.8 | 2.56 | Δ |
| 8.2 | 2.70 | x |

*1"EPVR" is the electroconductive polyimide volume resistivity.
*2"FNE" is the fixing non-uniformity evaluation.

An allowable level was evaluated by "x", "Δ", "oΔ" and "o". "x" is a level at which the fixing non-uniformity (non-uniformity of the fixing property) is confirmed and is recognized as an image defect, and is an unacceptable level. "Δ" is a level at which although the fixing non-uniformity is not confirmed, the uneven glossiness is recognized in the case where a solid image principally including a photographic image is outputted during a glossy paper mode in which gloss is enhanced by increasing a set fixing temperature or the like. When the image is outputted on plain paper in an ordinary process condition for the plain paper, somewhat uneven glossiness is recognized, there is no problem for outputting an image principally including a character image. "oΔ" is a level at which the fixing non-uniformity is not recognized and the uneven glossiness is unable to be recognized when the image is outputted on the plain paper in the ordinary process condition for the plain paper. At this level, although slight uneven glossiness can be confirmed, there is no problem. "o" is a level at which the fixing non-uniformity is not confirmed and even in the glossy paper mode, the uneven glossiness is unable to be recognized. From the above result, in the case where the image is outputted by a monochromatic machine (image forming apparatus) as in this embodiment, it was confirmed that the fixing non-uniformity was at the allowable (acceptable) level when the value of (Ra/Ca)/(Rb/Cb) was in a range from 0.39 to 2.5. Further, in the case where uniformity in gloss is required, it was able to be confirmed that when the value is in a range from 0.49 to 2.0, a further good result is obtained.

[Embodiment 4]

Another embodiment of the fixing device B will be described. The fixing device B in this embodiment is different in constitution of the film 1 from the fixing device B in Embodiment 1.

In the case where having a cylindrical shape is employed as the electrode layer 1*b* of the film 1, when a diameter of the electrode layer of the metal wire is gradually decreased, there is a problem that the heat does not readily generate. The heat does not readily generate due to an increase in sum of the resistance of the heat generating layer and a contact resistance by increasing the contact resistance between the electrode layer and the heat generating layer since as described in Embodiment 1, the heat is generated by causing the current to flow through the heat generating layer based on a potential difference formed by the electrode layer 1*b* with respect to the generatrix direction of the heat generating layer 1*a*.

In this embodiment, the heat generating layer 1*a* was formed in a cylindrical shape of 24 mm in inner diameter, 240 mm in length with respect to the generatrix direction of the heat generating layer, and 50 μm in thickness by subjecting a polyimide resin material to die molding. As form 1, the case where a tungsten wire of 50 μm in diameter was employed as the electrode layer 1*b* will be described. Further, as form 2, the case where a gold-plated tungsten wire of 60 μm in diameter was employed as the electrode layer 1*b* will be described. Further, as Comparison Example, the case where a SUS 304 wire of 20 μm in diameter was employed as the electrode layer 1*b* will be described.

Next, a verifying method of estimating a film resistance of the heat generating layer 1*a* and a contact resistance between the electrode layer 1*b* and the heat generating layer 1*a* will be described.

The film resistance and the contact resistance are estimated by measuring the resistance of the electrode layer 1*b* corresponding to one turn of the helical-shaped portion and the resistance between adjacent electrode layer portions with respect to the generatrix direction of the heat generating layer 1*a*. Here, the film resistance is Rf, the resistance of the electrode layer 1*b* corresponding to one turn of the helical-shaped portion is Rw, and the contact resistance between the electrode layer 1*b* and the heat generating layer 1*a* is Rc. Further, a combined resistance of the resistance Rw of the electrode layer 1*b* corresponding to one turn of the helical-shaped portion, the contact resistance Rc between the electrode layer 1*b* and the heat generating layer 1*a*, and the film resistance Rf is Rwcf. A combined resistance of the contact resistance Rc between the electrode layer 1*b* and the heat generating layer 1*a*, and the film resistance Rf is Rcf.

A measuring method will be described.

Figure 12:
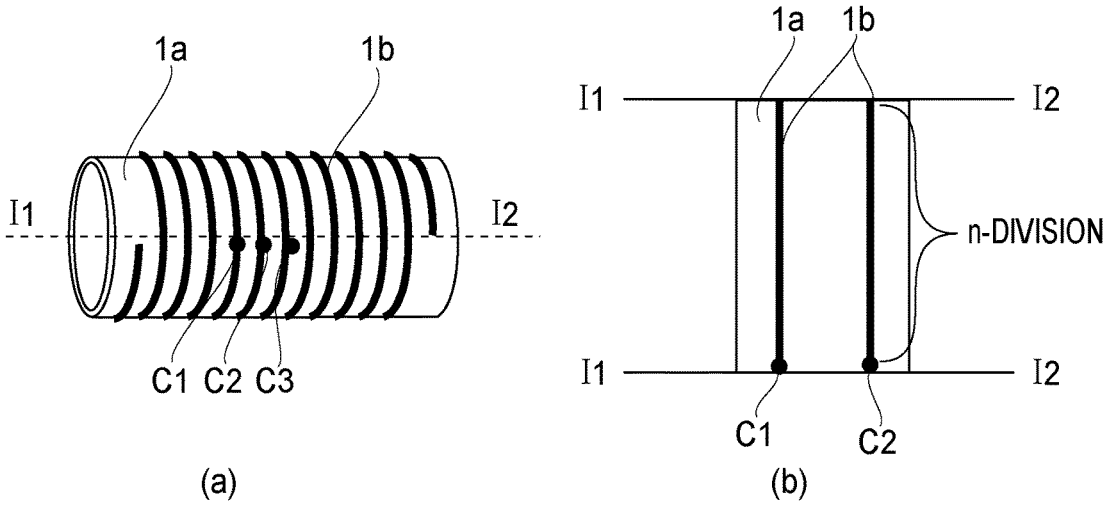
In FIG. 12, (a) and (b) are schematic views for illustrating a state in which an electrode layer of a film is cut in Embodiment 4.

In FIG. 12, (a) is a schematic view showing a state in which the electrode layer 1*b* is cut when the resistances are measured, and (b) is an enlarged schematic view of the electrode layer 1*b*, after being developed, when the resistances are measured.

As the measuring method, first, as shown in (a) of FIG. 12, the electrode layer 1*b* is cut along a rectilinear line I1-I2 extending in the generatrix direction of the heat generating layer 1*a*. Thus, the resistances can be measured every one turn of the electrode layer 1*b*. As regards the combined resistance Rwcf, the resistance between cut two electrode layer portions 1*b* and 1*b* is obtained by measuring a resistance between measuring points C1 and C2 shown in (b) of FIG. 12. Further, separately, the resistance Rw of the cut electrode layer 1*b* corresponding to one turn of the helical-shaped portion is obtained.

Next, a calculating method of the value of the combined resistance Rcf will be described.

Figure 13:
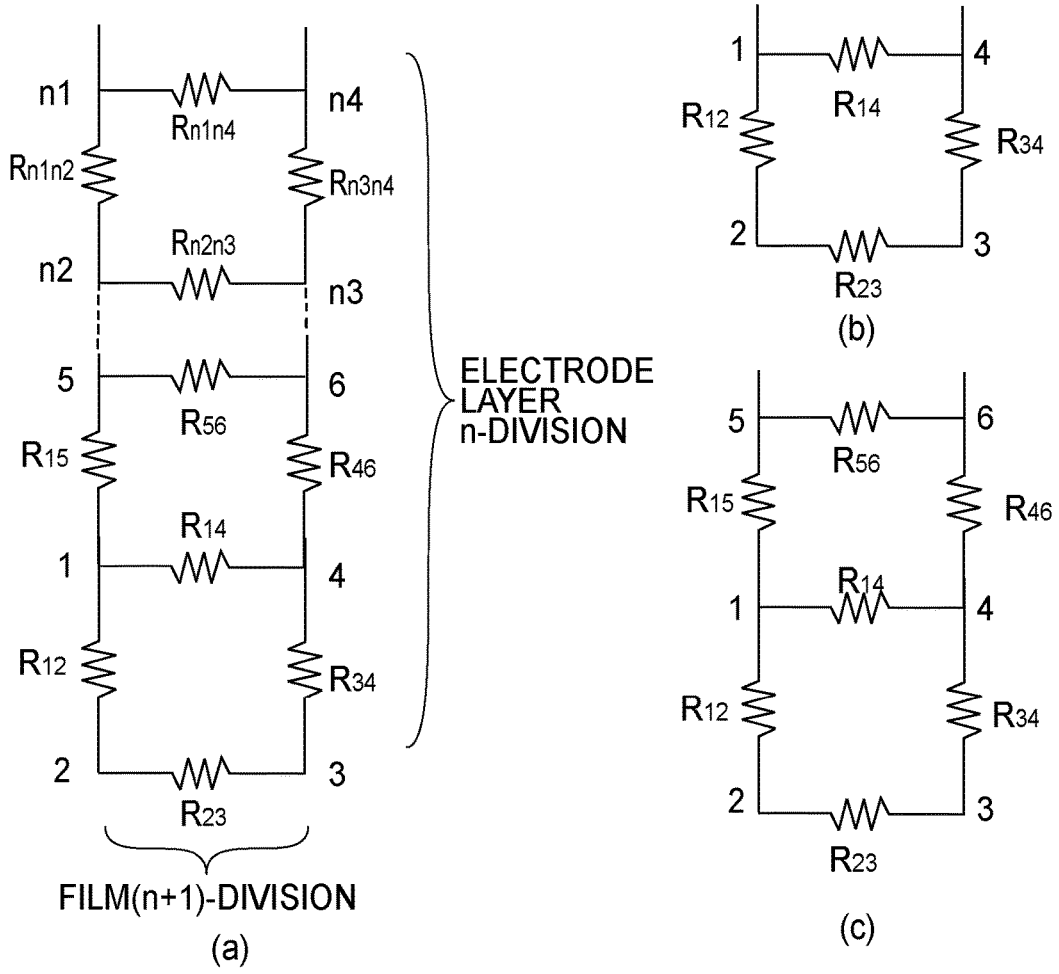
In FIG. 13, (a) to (c) are circuit views each showing an equivalent circuit including two electrode layers of the film and a heat generating layer at a portion sandwiched between the two electrode layers in Embodiment 4.

In FIG. 13, (a) is a schematic view of a developed electrode layer 1*b*, and (b) is an equivalent circuit of two electrode layer portions 1*b* and a heat generating layer portion 1*a* sandwiched between the two electrode layer portions 1*b*.

As shown in (a) of FIG. 13, the electrode layer 1*b* is divided into n portions consisting of $R_{12}$, $R_{15}$, . . . , $R_{n1n2}$. The respective divided resistances are values obtained by dividing the resistance Rw of the electrode layer 1*b* corresponding to one turn of the helical-shaped portion by n. The heat generating layer 1*a* is divided into n+1 portions consisting of $R_{23}$, $R_{14}$, $R_{56}$, . . . , $R_{n2n3}$, $R_{n1n4}$. The respective divided resistances are values obtained by multiplying the combined resistance Rwcf by n+1. By performing repetitive calculation in which n of the equivalent circuit is gradually increased, the combined resistance Rcf can be calculated.

First, in (b) of FIG. 13, the equivalent circuit of the electrode layer and the heat generating layer when n is 1, i.e., when the case where the electrode layer 1*b* is subjected to one division and the heat generating layer 1*a* is divided into two portions is taken into consideration is shown. $R_{12}$ and $R_{34}$ represent the resistances of the electrode layer 1*b*. $R_{23}$ and $R_{34}$ represent the resistances of the heat generating layer 1*a*. A combined portion of the contact resistance Rc between the electrode layer 1*b* and the heat generating layer 1*a*, and the film resistance Rf at this time is $R_1$cf. This combined resistance $R_1$cf is a combined resistance $R_{1234}$ of $R_{12}$, $R_{23}$ and $R_{34}$ connected in series and parallely-connected $R_{14}$. The combined resistance $R_{1234}$ is represented by the following formula (12).

$$\frac{1}{R_{1234}} = \frac{1}{(R_{12} + R_{23} + R_{34})} + \frac{1}{R_{14}} \tag{12}$$

$R_{12}$ and $R_{34}$ are the resistance $R_w$. $R_{23}$ and $R_{14}$ are the combined resistance $R_1$cf×2. The combined resistance $R_{1234}$ is the combined resistance Rwcf, and therefore by substituting the measured Rwcf and Rw for the corresponding resistances in the formula (12), the combined resistance $R_1$ cf is calculated.

In (c) of FIG. 13, an equivalent circuit of the electrode layer and the heat generating layer when n is 2, i.e., when the case where the electrode layer 1*b* is divided into two portions and the heat generating layer 1*a* is divided into three portions is taken into consideration is shown. $R_{12}$, $R_{34}$, $R_{15}$ and $R_{46}$ represent resistances of the electrode layer 1*b*. $R_{23}$, $R_{14}$ and $R_{56}$ represent resistances of the heat generating layer 1*a*. A combined resistance of the contact resistance between the electrode layer 1*b* and the heat generating layer 1*a*, and the film resistance Rf at this time is $R_2$ cf. A combined resistance of $R_{12}$, $R_{23}$ and $R_{34}$ connected in series and the parallely-connected $R_{14}$ is $R_{1234}$. Further, a combined resistance $R_{152346}$ is a combined resistance of $R_{15}$, $R_{1234}$ and $R_{46}$ connected in series and parallely-connected $R_{56}$. The combined resistance $R_{152346}$ is represented by the following formula (13).

$$\frac{1}{R_{152346}} = \frac{1}{(R_{15} + R_{1234} + R_{46})} + \frac{1}{R_{56}} \tag{13}$$

$R_{12}$, $R_{34}$, $R_{15}$ and $R_{46}$ are the resistance $R_w/2$, and $R_{23}$, $R_{14}$ and $R_{56}$ are the combined resistance $R_1$cf×3. The combined resistance $R_{152346}$ is the combined resistance Rwcf, and therefore by substituting the measured Rwcf and Rw for the corresponding resistances in the formula (13), the combined resistance $R_2$ cf is calculated.

By making the calculation as described above, it is possible to calculate the resistances in the case where the electrode layer 1*b* is divided into n portions and the heat generating layer 1*a* is divided into n+1 portions.

In the Form 1 of this embodiment, when the resistance between the measuring points C1 and C2 was measured in the case where a distance adjacent electrode layer portions 1*b* with respect to the generatrix direction of the heat generating layer 1*a* is 2 mm, Rw=2Ω and Rwcf=4Ω were obtained. Incidentally, the measurement of the resistances was carried out using a digital multi-meter ("Model 189, manufactured by Fluke Corp.) was used.

Figure 14:
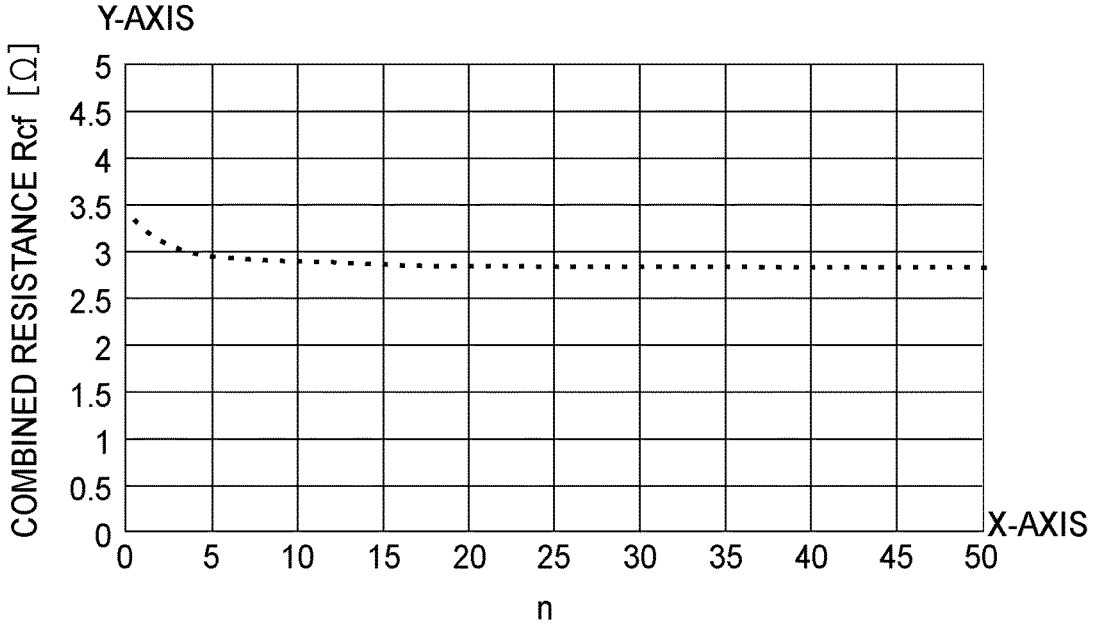
FIG. 14 is a graph showing a result of repetitive calculation of a combined resistance Rcf of the film in Embodiment 4.

FIG. 14 shows a result of repetitive calculation until n=50 for the combined resistance Rcf.

As shown in FIG. 14, in this embodiment, in the repetitive calculation of about n=30, the combined resistance Rcf converges to a value of 2.8Ω. The distance between the electrode layer portions is changed, and then a similar resistance measurement is carried out for a plurality of electrode layer portions 1*b*. In this embodiment, when the resistance was measured between the measuring points C1 and C3 in the case where the distance between the electrode layer portions was 4 mm, Rwcf=4.4Ω was obtained. In the repetitive calculation of n=30, Rcf was 3.2Ω.

Figure 15:
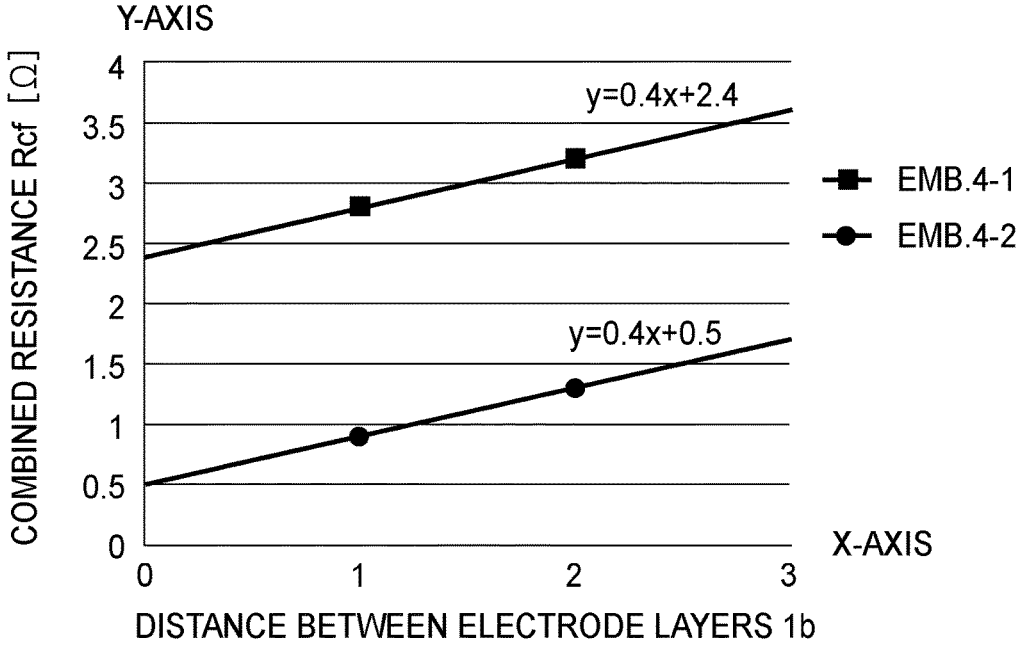
FIG. 15 is a graph showing a relationship between a diameter between adjacent electrode layers and the combined resistance Rcf obtained by the repetitive calculation in Embodiments 4-1 and 4-2.

FIG. 15 shows a relationship between the distance between the electrode layer portions and the combined resistance Rcf calculated in the repetitive calculation in the Form 1 of this embodiment ("EMB. 4-1") and the Form 2 of this embodiment ("EMB. 4-2").

As shown in FIG. 15, the distance between electrode layer portions (the distance between adjacent electrode layer points is 1) is taken as x-axis, and the combined resistance Rcf calculated in the repetitive calculation is taken as y-axis. Then, the film resistance Rf between the electrode layer portions is slope, and the contact resistance between the electrode layer 1*b* and the heat generating layer 1*a* is 0.5 time of y-intercept, and therefore, it is possible to estimate Rf and Rc.

The film resistance Rf between the adjacent electrode layer portions calculated by the above method was 0.4Ω, and the contact resistance Rc between the electrode layer 1*b* and the heat generating layer 1*a* was 1.2Ω. Further, when a film resistance between outermost electrode layer portions with respect to the generatrix direction of the heat generating layer 1*a* is an outermost electrode layer film resistance, this resistance was 46Ω from the calculated film resistance between the adjacent electrode layer portions. The film resistance Rf between the adjacent electrode layer portions was a value lower than the contact resistance Rc between the electrode layer 1*b* and the heat generating layer 1*a*. The outermost electrode layer film resistance was a value higher than the contact resistance Rc between the electrode layer 1*b* and the heat generating layer 1*a*. The outermost electrode layer film resistance is a resistance value (Q) of the heat generating layer 1*a* between one end and the other end of the electrode layer 1*b* with respect to the generatrix direction of the heat generating layer 1*a*.

Further, in the Form 2 of this embodiment, when the resistance was measured in the case where a distance adjacent electrode layer portions 1*b* is 2 mm, Rw=1.5Ω and Rwcf=1.6Ω were obtained, and therefore, when the value of Rcf was obtained in the repetitive calculation of about n=30, the value of Rcf was 0.9Ω. The distance between the electrode layer portions is changed, and when the resistance was measured in the case where the distance between the electrode layer portions was 4 mm, Rwcf=2.1Ω was obtained. When the value of Rcf was measured in the repetitive calculation of about n=30, Rcf was 1.3Ω.

As shown in FIG. 15, when the distance between electrode layer portions is taken as x-axis, and the combined resistance Rcf calculated in the repetitive calculation is taken as y-axis, the film resistance Rf between the electrode layer portions is slope, and the contact resistance between the electrode layer 1*b* and the heat generating layer 1*a* is 0.5 time of y-intercept. As a result, the calculated film resistance Rf between the adjacent electrode layer portions in this embodiment was 0.4Ω, the outermost electrode layer film resistance was 46Ω, and the contact resistance Rc between the electrode layer 1*b* and the heat generating layer 1*a* was 0.25Ω. The film resistance Rf between the adjacent electrode layer portions and the outermost electrode layer film resistance were values higher than the contact resistance Rc between the electrode layer 1*b* and the heat generating layer 1*a*.

Also in Comparison Example, a similar measurement was carried out. In Comparison Example, when the resistance was measured in the case where a distance adjacent electrode layer portions 1*b* is 2 mm, Rw=200Ω and Rwcf=500Ω were obtained, and therefore, when the value of Rcf was obtained in the repetitive calculation of about n=30, the value of Rcf was 378Ω. The distance between the electrode layer portions is changed, and when the resistance was measured in the case where the distance between the electrode layer portions was 4 mm, Rwcf=501Ω was obtained. When the value of Rcf was measured in the repetitive calculation of about n=30, Rcf was 379Ω.

Figure 16:
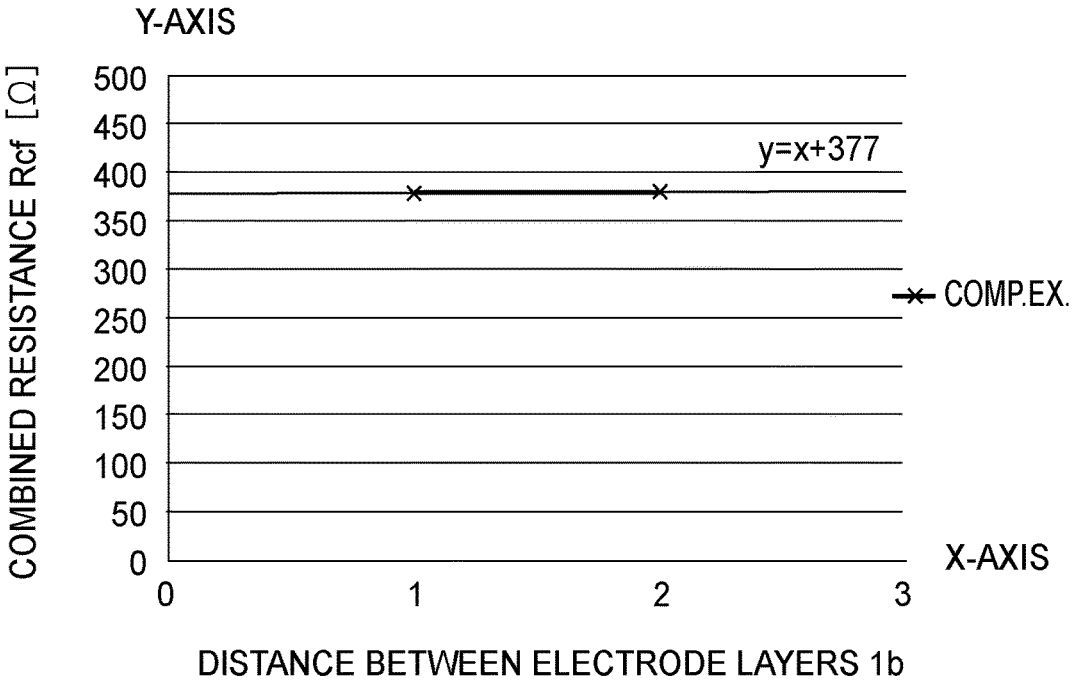
FIG. 16 is a graph showing a relationship between the diameter between adjacent electrode layers and the combined resistance Rcf of a film in Comparison Example described in Embodiment 4.

FIG. 16 shows a relationship between the distance between the electrode layer portions and the combined resistance Rcf calculated in the repetitive calculation for the film in Comparison Example.

As shown in FIG. 16, when the distance between electrode layer portions is taken as x-axis, and the combined resistance Rcf calculated in the repetitive calculation is taken as y-axis, the film resistance Rf between the electrode layer portions is slope, and the contact resistance between the electrode layer 1*b* and the heat generating layer 1*a* is 0.5 time of y-intercept. As a result, the calculated film resistance Rf between the adjacent electrode layer portions in Comparison Example was 1Ω, and the contact resistance Rc between the electrode layer 1*b* and the heat generating layer 1*a* was 189Ω. The film resistance Rf between the adjacent electrode layer portions was a value lower than the contact resistance Rc between the electrode layer 1*b* and the heat generating layer 1*a*.

When heat generation verification was performed using the power source of the commercial power source level described in Embodiment 1, the heat was generated in the Form 1 of this embodiment and the Form 2 of this embodiment. Further, the heat generation level in the Form 2 of this embodiment in which the contact resistance Rc between the electrode layer 1*b* and the heat generating layer 1*a* was low was higher than that in the Form 1 of this embodiment. In this embodiment, the contact resistance Rc between the electrode layer 1*b* and the heat generating layer 1*a* was high, and therefore, the heat was not generated.

In the case of the film constitution in this embodiment, the film resistance Rf between the adjacent electrode layer portions may desirably be $1.0\times10^{-1}$ to $1.0\times10^{3}$Ω. The contact resistance Rc between the electrode layer 1*b* and the heat generating layer 1*a* may preferably be low and may desirably be closer to 0Ω.

In order to cause the heat generating layer 1*a* to generate heat, the film resistance Rf may preferably be higher than the contact resistance Rc between the electrode layer 1*b* and the heat generating layer 1*a*. It is desirable that the film resistance Rf between the adjacent electrode layer portions with respect to the generatrix direction of the heat generating layer 1*a* is higher than the contact resistance Rc between the electrode layer 1*b* and the heat generating layer 1*a*. That is, the contact resistance Rc between the electrode layer 1*b* and the heat generating layer 1*a* is lower than the film resistance Rf between the adjacent electrode layer portions with respect to the generatrix direction of the heat generating layer 1*a*. The contact resistance Rc between the electrode layer 1*b* and the heat generating layer 1*a* is made lower than the resistance of the heat generating layer 1*a*, whereby it becomes possible to ensure the heat generation of the heat generating layer 1*a*.

[Embodiment 5]

Another embodiment of the fixing device B will be described. The fixing device B in this embodiment is different in constitution of the film 1 from the fixing device B in Embodiment 1.

The fixing device B in this embodiment has a feature that the electrode layer 1*b* of the film 1 was changed from the electroconductive wire to an electroconductive paste. Compared with the cylindrical electroconductive wire, by using the electroconductive paste, a contact area between the heat generating layer 1*a* and the electrode layer 1*b* can be increased, so that the contact resistance between the heat generating layer 1*a* and the electrode layer 1*b* can be lowered.

The electrode layer 1*b* can be prepared by applying an electroconductive paste, containing silver, carbon fiber, carbon nanotube or the like as a filler, onto the heat generating layer 1*a*. In this embodiment, as the electroconductive paste, a silver paste of $5.0\times10^{-7}$ Ωm in volume resistivity is applied by screen printing. The silver paste is prepared by dispersing silver fine particles into a polyimide resin material in a solvent, and is dried after being applied onto the heat generating layer 1*a*. The electroconductive paste was formed in a helical shape of 200 μm in width and 10 μm in thickness.

In this embodiment, the resistance measurement similar to that in Embodiment 2 was carried out. The resistances in the case where a distance between the adjacent electrode layer portions 1*b* was 2 mm were measured. Then, the resistance Rw of the electrode layer 1*b* corresponding to one turn of the helical-shaped portion was 2.6Ω, and the combined resistance Rwcf of the resistance Rw of the electrode layer 1*b* corresponding to one turn of the helical-shaped portion, the contact resistance Rc between the electrode layer 1*b* and the heat generating layer 1*a*, and the film resistance Rf was 1.7Ω. Then, when the value of the combined resistance Rcf of the contact resistance Rc between the electrode layer 1*b* and the heat generating layer 1*a*, and the film resistance Rf was obtained in the repetitive calculation of about n=30, the value of the combined resistance Rcf was 0.6Ω.

The distance between the electrode layer portions was changed, and when the resistance was measured in the case where the distance between the electrode layer portions was 4 mm, the combined resistance Rwcf=2.3Ω was obtained. When the value of the combined resistance Rcf was measured in the repetitive calculation of about n=30, Rcf was 1.0Ω.

Figure 17:
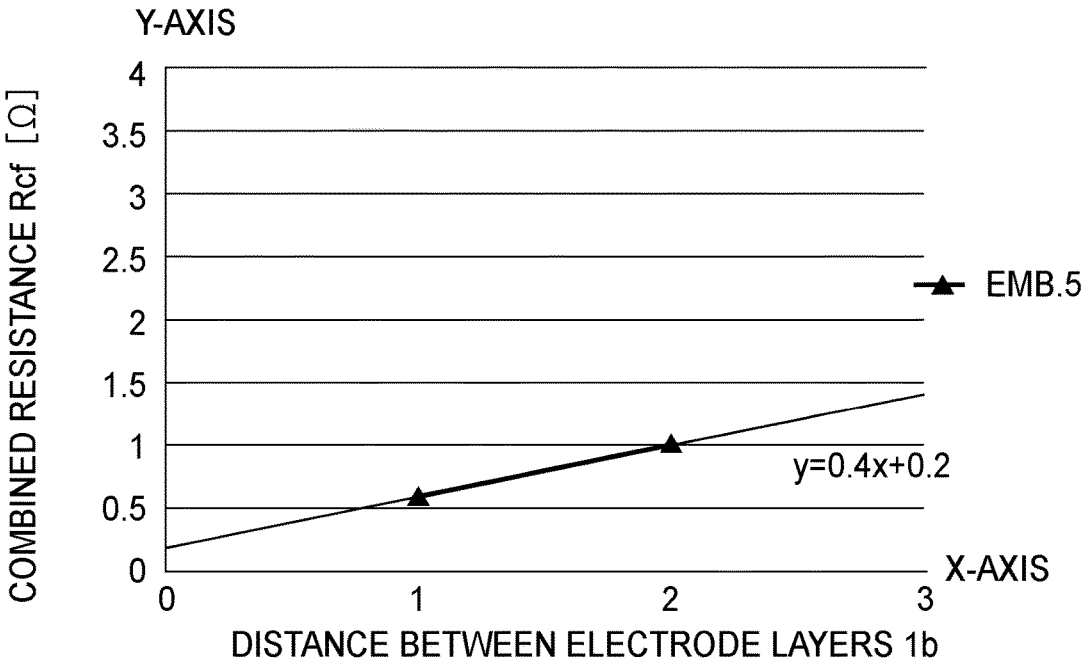
FIG. 17 is a graph showing a relationship between the diameter between adjacent electrode layers and the combined resistance Rcf of a film in Embodiment 5.

FIG. 17 shows a relationship between the distance between the electrode layer portions and the combined resistance Rcf calculated in the repetitive calculation for the film 1 in this embodiment.

As shown in FIG. 17, when the distance between electrode layer portions is taken as x-axis, and the combined resistance Rcf calculated in the repetitive calculation is taken as y-axis, the film resistance Rf between the electrode layer portions is slope, and the contact resistance between the heat generating layer 1*a* and the electrode layer 1*b* is 0.5 time of y-intercept. As a result, the calculated film resistance Rf between the adjacent electrode layer portions in this embodiment was 0.4Ω, and the contact resistance Rc between the heat generating layer 1*a* and the electrode layer 1*b* was 0.1Ω. When the heat generation verification was performed using the power source of the commercial power source level described in Embodiment 1, the heat generation was obtained.

As described above, by changing the electrode layer 1*b* from the electroconductive wire to the electroconductive paste, it becomes possible to increase the contact area between the heat generating layer 1*a* and the electrode layer 1*b*, so that the contact resistance Rc between the heat generating layer 1*a* and the electrode layer 1*b* can be lowered.

In this embodiment, the electrode layer 1*b* prepared by the screen printing of the electroconductive paste was described, but another method capable of increasing the contact area between the heat generating layer 1*a* and the electrode layer 1*b* may also be used. As a method of lowering the contact resistance between the heat generating layer 1*a* and the electrode layer 1*b*, a portion, of the heat generating layer 1*a*, where the electrode layer 1*b* is formed, is subjected to platable pretreatment, and then the electrode layer 1*b* may also be formed by metal plating through electroless plating.

Particularly, a positional relationship between a screen and the film is controlled by forming the electrode layer through the screen printing or the like, so that a pitch interval and longitudinal positional accuracy can be ensured. For this reason, also during mass production, it becomes possible to form the electrode layer with a stable pitch interval.

[Embodiment 6]

Another embodiment of the fixing device B will be described. The fixing device B in this embodiment is different in constitution of the film 1 from the fixing device B in Embodiment 3.

In this embodiment, an elastic layer of the film is used as the heat generating layer, so that the temperature of the film surface can be quickly increased, and therefore a time from a start of rising (actuation) of the fixing device until the image forming apparatus is in a printable state is made further quick.

A structure of the film in this embodiment will be described.

Figure 19:
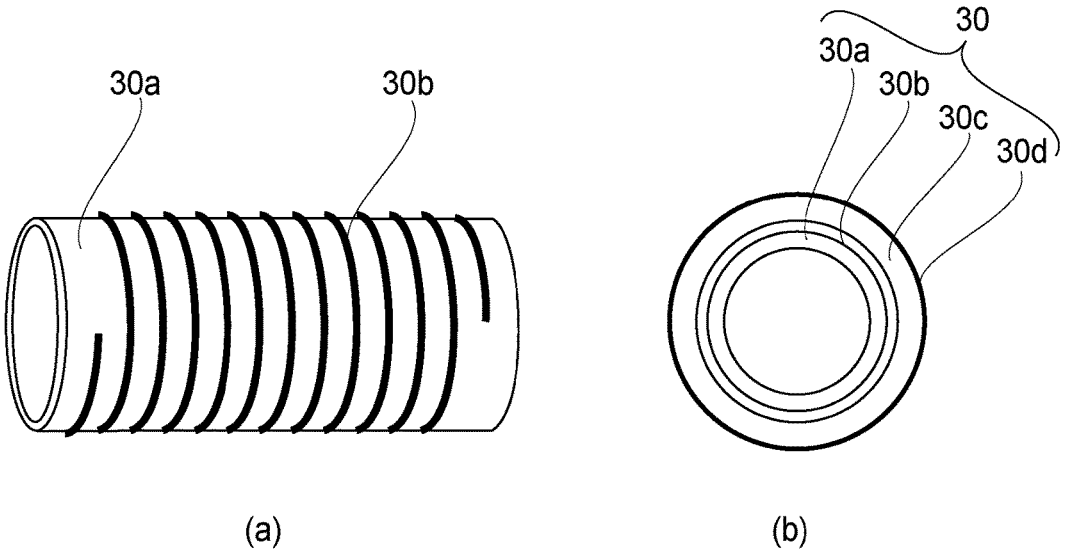
In FIG. 19, (a) and (b) are schematic views for illustrating a structure of a film in Embodiment 6.

In FIG. 19, (a) is a perspective view showing a base layer 30*a* of a film 30 and an electrode layer 30*b* formed on an outer peripheral surface of the base layer 30*a*, and (b) is a schematic view for illustrating a layer structure of the film 30.

As shown in (b) of FIG. 19, the film 30 is a cylindrical rotatable member having a composite structure including a cylindrical base layer 30*a*, the electrode layer 30*b*, an elastic layer 30*c* also functioning as a heat generating layer and a parting layer 30*d*. That is, the film 30 includes the electrode layer 30*b* helically formed on an outer peripheral surface of the cylindrical base layer 30*a*. The electrode layer 30*b* contacts the surface of the base layer 30*a*. The elastic layer 30*c* also functioning as the heat generating layer is laminated so as to cover the electrode layer 30*b* formed on the surface of the base layer 30*a*, and then the parting layer 30*d* is laminated on an outer peripheral surface of the elastic layer 30*c* also functioning as the heat generating layer.

A detailed structure of the film 30 will be described below.

First, the base layer 30*a* is formed of a heat-resistant resin material such as polyimide, polyamideimide, PEEK or PES, and is molded in a cylindrical shape of 30 μm-100 μm in thickness. In this embodiment, the polyimide resin material is molded using a die in a cylindrical shape of 25 mm in inner diameter, 240 mm in longitudinal length and 50 μm in thickness, so that the base layer 30*a* was formed. Incidentally, in this embodiment, electroconductive particles such as carbon black or metal powder are not added and dispersed in the polyimide resin material of the base layer 30*a*.

Next, the electrode layer 30*b* can be prepared by applying an electroconductive paste (electroconductive member), containing silver, carbon fiber, carbon nanotube or the like as a filler, onto the base layer 30*a*. In this embodiment, as the electroconductive paste, a silver paste of $5.0\times10^{-7}$ Ωm in volume resistivity is applied by screen printing. The silver paste is prepared by dispersing silver fine particles into a polyimide resin material in a solvent, and is dried after being applied onto the heat generating layer 1*a*. The electroconductive paste was formed in a helical shape of 200 μm in width and 10 μm in thickness.

Then, the elastic layer 30*c* also functioning as the heat generating layer was formed along the generatrix direction of the base layer 30*a* so as to cover the electrode layer 30*b* on the surface of the base layer 30*a* in a state shown in (a) of FIG. 19. The elastic layer 30*c* also functioning as the heat generating layer is a heat-resistant rubber such as a silicone rubber or a fluorine-containing rubber in which an electroconductive material such as carbon black, carbon fibers or metal powder is added and dispersed. By adding and dispersing the electroconductive material into the heat-resistant rubber, electroconductivity is imparted to the elastic layer 30*c*, so that the elastic layer 30*c* functions as the heat generating layer.

In this embodiment, as the elastic layer 30*c* also functioning as the heat generating layer, the silicone rubber adjusted to $3.0\times10^{-3}$ Ωm in volume resistivity by adding and dispersing therein carbon black as electroconductive particles which are the electroconductive material (electroconductive member) was formed in a layer of 300 μm in thickness. In the constitution in this embodiment, the silicone rubber covers the electrode, and therefore a contact area between the silicone rubber and the electrode is large, so that the contact resistance can be suppressed to a low value.

Then, on the surface of the elastic layer 30*c* also functioning as the heat generating layer, a 30 μm-thick fluorine-containing resin tube was coated as the parting layer 30*d* along the generatrix direction of the base layer 30*a* by a thermal contraction method. This parting layer 30*d* has a function of preventing the surface of the film 30 from being contaminated with the toner and the paper powder which are deposited on the film surface.

The heat generating layer 1*a* in Embodiment 3 was formed as the polyimide resin layer of about $5.0\times10^{-3}$ Ωm in volume resistivity and 50 μm in thickness. On the other hand, in this embodiment, as the elastic layer 30*c* also functioning as the heat generating layer, the layer is formed so as to have the volume resistivity of about $3.0\times10^{-3}$ Ωm and the thickness of 300 μm. Embodiment 3 and this embodiment are substantially the same in resistance $R_{SLVb}$ obtained from the formula (11) with respect to the generatrix direction of the heat generating layer, so that also in this embodiment, it is possible to obtain the heat generation performance substantially equal to that in Embodiment 3.

In this embodiment, the case where the base layer has not electroconductivity and does not generate the heat was described. However, the electroconductivity may also be imparted to the base layer by adding and dispersing the electroconductive material such as the carbon black, the carbon fibers or metal powder into the polyimide resin material of the base layer. That is, both of the polyimide resin material of the base layer and the silicone rubber of the heat generating layer may also be caused to generate the heat.

As described above, in this embodiment, the elastic layer in a side closer to the surface layer is used as the heat generating layer, so that the film surface temperature can be increased more quickly and electric power necessary from a start of rising of the fixing device until the image forming apparatus is in a printable state can be suppressed to a low value.

[Embodiment 7]

Another embodiment of the fixing device B will be described. The fixing device B in this embodiment is different in constitution of the film 1 from the fixing device B in Embodiment 1.

In the method of winding the metal wire at the resin film surface, contact between the metal wire and the resin film becomes unstable, so that heat generation non-uniformity occurs in some cases. The nip is formed by the rotatable heating member and the pressing roller which are configured to sandwich the recording material, and fixing is carried out while feeding the recording material to the nip, and therefore, even in the fixing device which is susceptible to repetitive bending (flexion) due to deformation of the rotatable heating member, the heat is stably generated through a durability test.

A structure of the film in this embodiment will be described.

In FIG. 20, (a) is a perspective view showing a heat generating layer 40*a* and an electrode layer 40*b* of a film 40, (b) is a schematic view for illustrating a layer structure of the film 40, and (c) is a schematic view showing a part of a cross section of the film 40 with respect to a longitudinal direction.

The film 40 in this embodiment is a composite film including a cylindrical rotatable member consisting of the heat generating layer 40*a* and a parting layer 40*c* formed on the surface of the heat generating layer 40*a*, and in the heat generating layer 40*a*, the electrode layer 40*b* is formed in a helical shape and is incorporated. By incorporating the electrode layer 40*b* in the heat generating layer 40*a*, a contact area between the heat generating layer 40*a* and the electrode layer 40*b* is increased, so that the contact resistance can be lowered.

A detailed structure of the film 40 will be described.

The heat generating layer 40*a* of the film 40 in this embodiment is prepared by dispersing carbon black and carbon fibers in the polyimide resin material, so that the volume resistivity thereof is about $5.0\times10^{-4}$ Ωm. The film 40 is a cylindrical film having a size of 30 mm in inner diameter, 240 mm in longitudinal length and 80 μm in thickness.

As another example of the heat generating layer 40*a*, a layer of a heat-resistant resin material such as polyimide, polyamideimide, PEEK or PES in which electroconductive particles such as carbon black or metal powder are added and dispersed can be used.

The electrode layer 40*b* was prepared using a SUS304 wire of 50 μm in diameter and about $7.0\times10^{-7}$ Ωm and is formed in a helical shape in the heat generating layer 40*a* by a manufacturing method described later. Further, both end portions of the electrode are not short-circuited to an adjacent electrode, so that a closed loop is not formed.

As another example of the electrode layer 40*b*, a metal wire which is smaller in volume resistivity than the heat generating layer 40*a* and which is formed of iron, copper, silver, aluminum, nickel, chromium, tungsten or an alloy such as SUS 304 or nichrome can be used. Or, an electroconductive wire formed of an electroconductive resin material such as CFRP (carbon fiber-reinforced plastic) or carbon nanotube resin can be used. Further, the electrode layer 40*b* is not required to be the wire, but it is possible to use a sandwich structure in which an electroconductive paste in which silver, carbon fibers, carbon nanotube or the like is contained as a filler is formed on the heat generating layer surface, and thereon, a heat generating layer is further formed.

Thus, by burying the electrode in the heat generating layer, the contact resistance between the electrode and the electroconductive resin material can be lowered, and at the same time, the electrode is prevented from floating from the electroconductive resin material even when the electrode is subjected to repetitive bending (flexion) by rotation of the film, so that stable heat generation can be realized.

Next, a film manufacturing method will be described.

The cylindrical film in which the electrode layer 40*b* is incorporated in the heat generating layer 40*a* can be manufactured by the following method.

Figure 21:
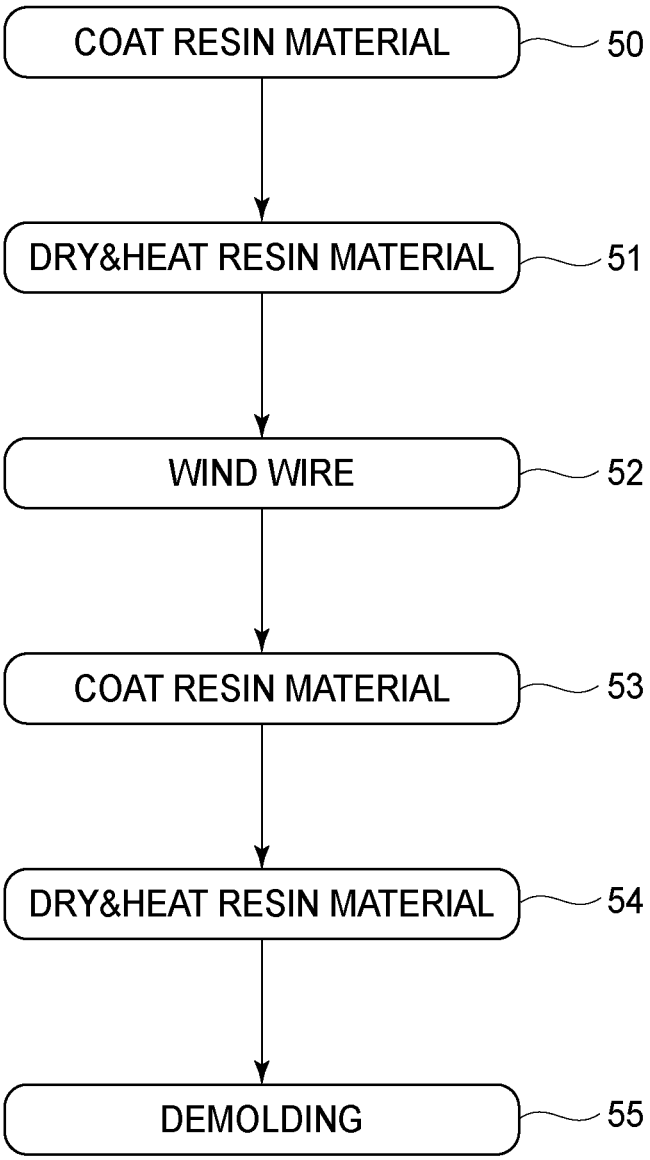
FIG. 21 is a flowchart showing manufacturing steps of the film in Embodiment 7.

FIG. 21 is a flowchart of steps for illustrating a flow of film manufacturing steps.

First, a polyimide varnish is applied onto a cylindrical support having a surface which has been washed (50).

The polyimide varnish is prepared by adding and dispersing an electroconductive agent, such as carbon black or carbon fibers, in a solution of a polyimide precursor in an organic solvent in advance. At this time, as regards an amount of the electroconductive agent added in the polyimide varnish, when the electroconductive agent was added in an amount of 10 wt. % or more in an entirety of a solid content of the polyimide varnish, the volume resistivity is smaller than $1.0\times10^{-5}$ Ωm, so that the heat can be sufficiently generated without increasing a voltage applied to the exciting coil to a so large value.

Then, the support on which the polyimide varnish is applied is placed in a heating oven and then is dried and heated (51).

By this drying and heating process, not only the solvent of the polyimide varnish is volatilized but also imidization occurs, so that cross-linking of the resin is accelerated and a coating film is formed. A condition of the drying and heating process varies depending on the kind of the polyimide varnish used and the thickness of the coating film formed, but the coating film is first heated in a range of 100-150° C. for several tens of minutes and then is stepwisely increased to 200-400° C. in several hours, so that a degree of expansion of the film is small and thus a dimension is stabilized.

Thereafter, the cylindrical support is once cooled as a whole and then is taken out from the heating oven.

At one end portion of a side surface of the thus-formed coating film, an end portion of the metal wire formed of SUS 304 and 50 μm in diameter was bonded with a heat-resistant adhesive. Thereafter, by a shaft rotating method, the metal wire is wound around the coating film with regular intervals, so that the helical-shaped electrode layer 40*b* is prepared (52). Also in an end point side where the winding of the metal wire is ended, the other end portion of the metal wire is bonded and fixed.

Then, onto the wire-wound support, the polyimide varnish is applied again (53).

Thereafter, the support is placed in the heating oven and is subjected to the drying and heating process, so that the coating with the electroconductive resin material can be carried out so as to cover the metal wire (54).

Finally, after the cylindrical support is cooled, the support is taken out from the heating oven and is cut at the end portions so that the film has a desired length, and then the film is drawn out from the support (55).

Here, a resin coating method will be described.

Figure 22:
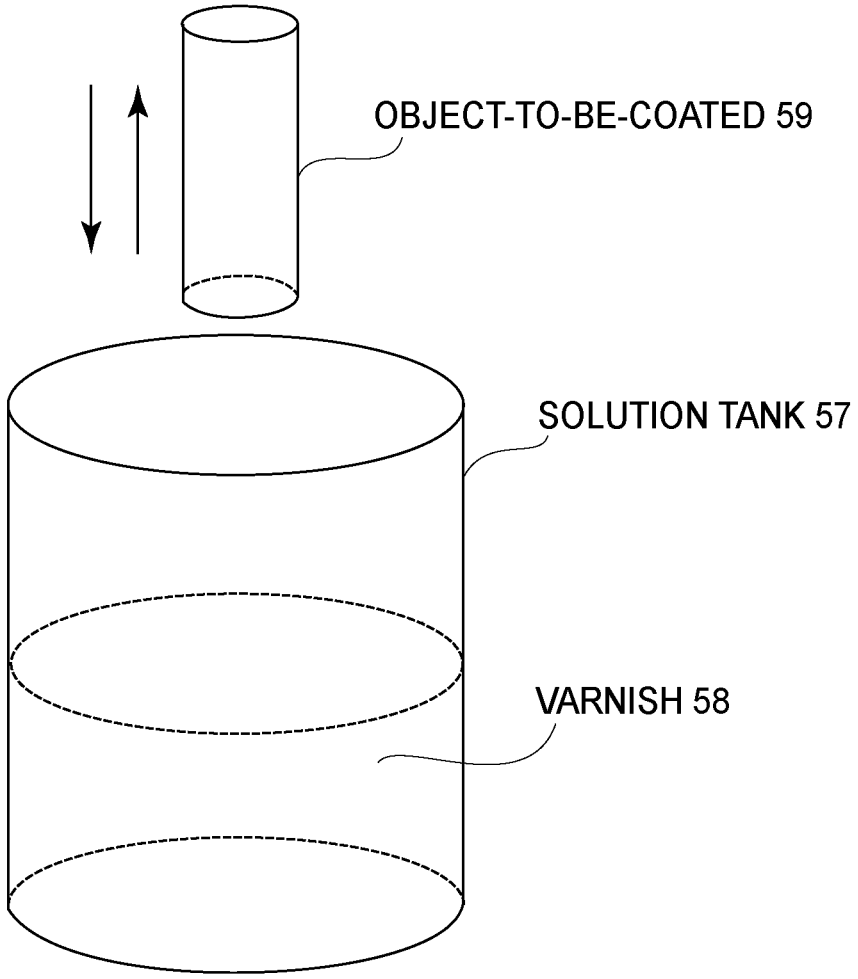
FIG. 22 is a schematic view for illustrating a method of coating an electroconductive resin material by dipping.

FIG. 22 shows, as the resin coating method, a method of dipping an object-to-be-coated in a solution of an organic solvent to form the coating film (herein referred to as a dipping (method)).

In a solution tank 57, a prepared polyimide varnish 58 is stored, and an object-to-be-coated 59 is dipped in the polyimide varnish 58 and then is pulled up at a predetermined speed, so that a coating film having a desired thickness is formed on the surface of the object-to-be-coated 59.

This method is suitable for the case where in the above-described coating steps (50) and (53), the object-to-be-coated 59 is coated with the same material, and there is no need to effect masking of the object-to-be-coated, and therefore, a resin layer can be easily formed.

In the above-described coating steps (50) and (53), the same material is not necessarily be required to be used. For example, another solution tank is prepared, and in the coating step (53) after the winding of the wire, the dipping of the object-to-be-coated in a solution of an organic solvent in which a viscosity of the polyimide varnish is large is performed, so that a degree of unevenness of the wire portion at the film surface can be reduced. Further, in the coating step (50) for forming an inner surface of the film, a polyimide varnish in which an addition amount of the electroconductive agent is suppressed is prepared, and only in the coating step (53) for forming the front (outer) surface of the film, the volume resistivity may also be decreased. As a result, a sliding property of the inner surface of the electroconductive resin film can be improved.

Figure 23:
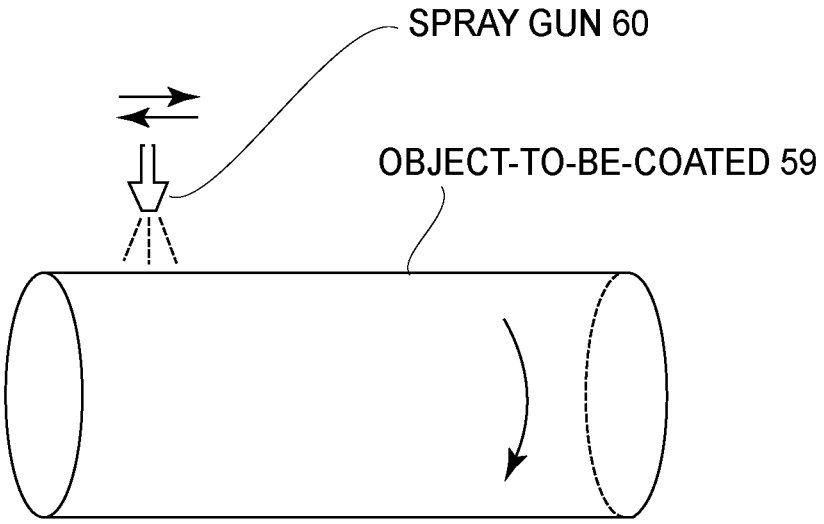
FIG. 23 is a schematic view for illustrating a method of coating the electroconductive resin material by spray coating.
Figure 24:
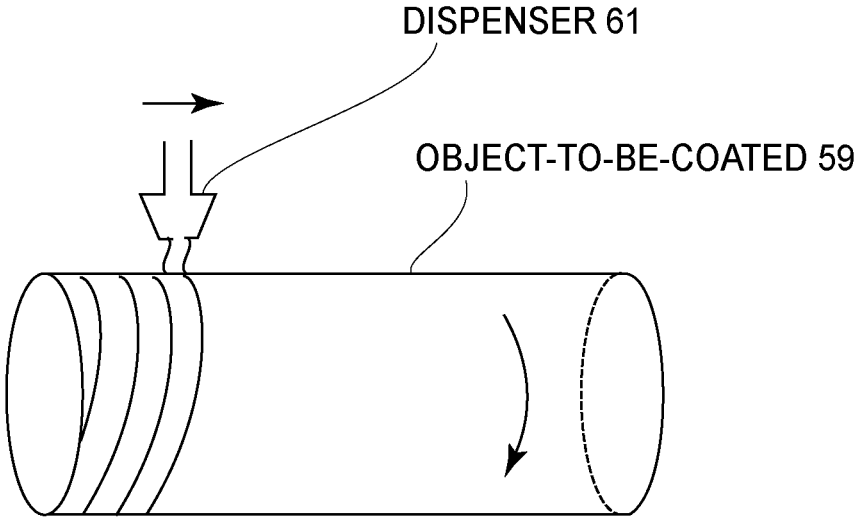
FIG. 24 is a schematic view for illustrating a method of coating the electroconductive resin material by a dispenser.

Further, as another resin coating method, as shown in FIG. 23, it is possible to select a method of blowing a resin material by a spray gun 60 while rotating the object-to-be-coated 59 (herein referred to as spray coating (method)). Or, as shown in FIG. 24, it is possible to select a method of helically coating a polyimide varnish from above a rotating object-to-be-coated 59 by using a dispenser 61 capable of quantitatively discharging the polyimide varnish (herein referred to as a dispenser method).

Figure 25:
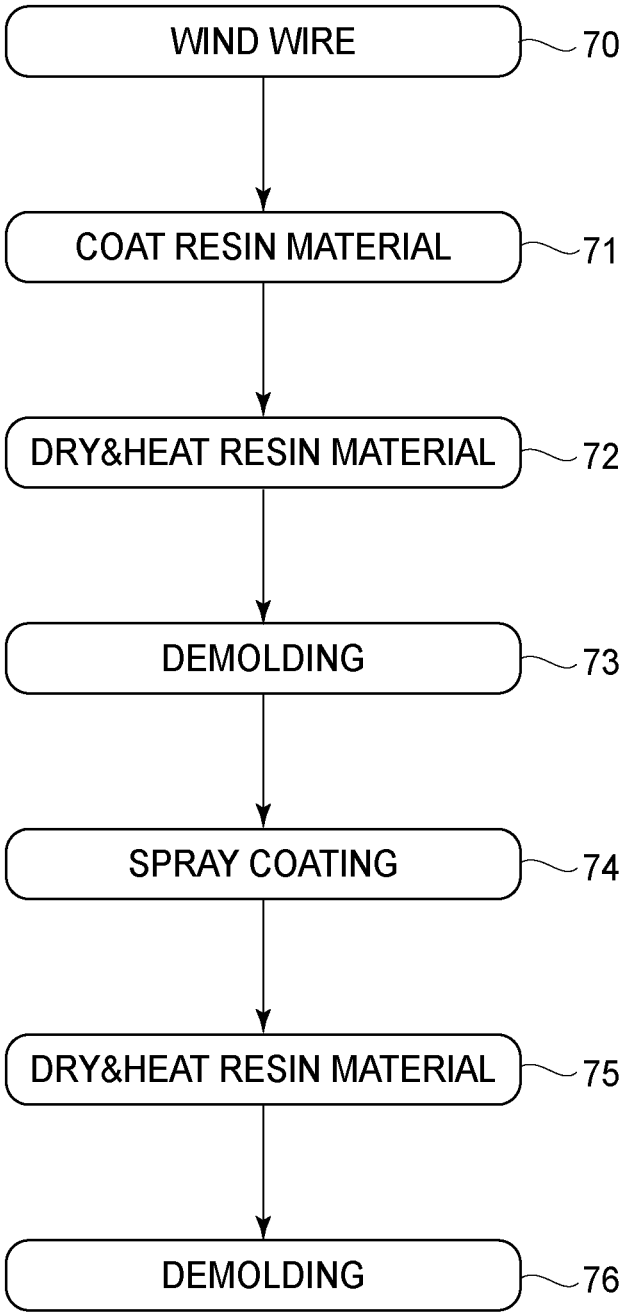
FIG. 25 is a flowchart showing manufacturing steps of the film in Embodiment 7.

As another film manufacturing method, as shown in a flowchart of a film manufacturing process of FIG. 25, a method of first winding the metal wire around the cylindrical support.

Specifically, on the cylindrical support, a helically shaped electrode 1*b* is prepared by equidistantly winding the metal wire around the support by the shaft rotating method (70).

Then, on the cylindrical support, the polyimide varnish (electroconductive member) is coated (71).

Subsequently, the resultant support is placed in the heating oven and is subjected to the drying and heating process (72).

The cylindrical support is taken out from the heating oven, and a prepared film (outer layer) is once drawn out from the support (73).

Next, an inner surface of the film is coated with the polyimide varnish (electroconductive member) (74).

Thereafter, the coated film is placed in the heating oven again and is subjected to the drying and heating process, so that coating of the electroconductive resin material is carried out so as to cover the metal wire (75).

Finally, after the cylindrical support is cooled, the support is taken out from the heating oven, and end portions thereof are cut so that the film has a desired length, and thereafter the film is drawn out from the support (76).

Here, as the method of coating the film inner surface with the polyimide varnish, the above-described spray coating or the dispenser method can be selected.

In the above, the manufacturing method until the heat generating layer 40*a* of the film 40 in which the electrode layer 40*b* is incorporated in the heat generating layer 40*a* was described.

Subsequently, on the surface of the heat generating layer 40*a*, a fluorine-containing resin material such as PTFE, PFA or FEP is coated, dried and baked, so that the film 40 to which a parting property from the toner and the paper powder is imparted is prepared. Here, PTFE is polytetrafluoroethylene, PFA is polytetrafluoroethylene-perfluoroalkylvinyl ether copolymer, and FEP is polytetrafluoroethylene-hexafluoropropylene copolymer.

Further, in this embodiment, as the film the film having a two-layer structure in which the parting layer is coated on the heat generating layer was described, but a film in which a primer layer and the elastic layer are coated on the heat generating layer and the parting layer is coated on the elastic layer can also be used as the film. By forming the elastic layer between the film and the parting layer, followability to paper having a large degree of unevenness is improved, so that a clearer fixed image can be obtained.

Further, in this embodiment, as the heat generating layer, the layer of the electroconductive resin material was described, but this layer is also applicable to the heat generating layer also functioning as the heat generating layer as described in Embodiment 4.

As described above, in this embodiment, the electrode layer is helically incorporated in the heat generating layer, so that the contact between the heat generating layer and the electrode layer is stably maintained, and thus it is possible to stably generate the heat through continuous image formation (durability test).

[Other Embodiments]

The image heating apparatus according to the present invention is not limited to use as the fixing devices as in the above-descried embodiments. The image heating apparatus can also be used as an image heating apparatus for heating an image in order to modify glossiness of an image (fixed image) once fixed on the recording material or an image (partly fixed image) temporarily fixed on the recording material.

INDUSTRIAL APPLICABILITY

According to the present invention, it is possible to provide a cylindrical fixing member excellent in temperature rising speed, a fixing device including the cylindrical fixing member, and an image forming apparatus including the cylindrical fixing member.

The invention claimed is:

1. A cylindrical fixing member for use with a fixing device, comprising:

a heat generating layer; and an electrode layer contacting said heat generating layer, wherein said electrode layer is smaller in volume resistance value than said heat generating layer, wherein said electrode layer is formed in a helical shape so that a helical axis thereof extends in a direction along a generatrix direction of said fixing member from one end toward the other end of said electrode layer.

2. The cylindrical fixing member according to claim 1, wherein a contact resistance between said electrode layer and said heat generating layer is lower than a resistance value of said heat generating layer between said one end and said the other end of said electrode layer with respect to the generatrix direction.

3. The cylindrical fixing member according to claim 1, wherein a contact resistance between said electrode layer and said heat generating layer is smaller than a resistance of said heat generating layer between adjacent parts of said electrode layer with respect to the generatrix direction.

4. The cylindrical fixing member according to claim 1, wherein said heat generating layer is a resin layer in which an electroconductive material is dispersed, and said electrode layer is a layer formed of metal.

5. The cylindrical fixing member according to claim 1, wherein said electrode layer is formed inside said heat generating layer.

6. The cylindrical fixing member according to claim 1, wherein said electrode layer is formed on an outer peripheral surface of said heat generating layer.

7. The cylindrical fixing member according to claim 6, further comprising an elastic layer formed outside said electrode layer.

8. A fixing device comprising:

a cylindrical fixing member, wherein said cylindrical fixing member includes, a heat generating layer and an electrode layer contacting said heat generating layer, wherein said electrode layer is smaller in volume resistance value than said heat generating layer, wherein said electrode layer is formed in a helical shape so that a helical axis thereof extends in a direction along a generatrix direction of said fixing member from one end toward the other end of said electrode layer;

a coil provided at a hollow portion of said cylindrical fixing member, wherein said coil includes a helical stepped portion having a helical axis extending in a direction along the generatrix direction of said cylindrical fixing member, and a magnetic field is formed for subjecting said heat generating layer to electromagnetic induction heating by causing an alternating current to flow through said coil; and a magnetic core provided inside the helical stepped portion of said coil and extending in the generatrix direction, wherein an image formed on a recording material is fixed on the recording material by heat from said cylindrical fixing member.

9. The fixing device according to claim 8, wherein a contact resistance between said electrode layer and said heat generating layer is lower than a resistance value of said heat generating layer between said one end and said the other end of said electrode layer with respect to the generatrix direction.

10. The fixing device according to claim 8, wherein a contact resistance between said electrode layer and said heat generating layer is smaller than a resistance of said heat generating layer between adjacent parts of said electrode layer with respect to the generatrix direction.

11. The fixing device according to claim 8, wherein said heat generating layer is a resin layer in which an electroconductive material is dispersed, and said electrode layer is a layer formed of metal.

12. The fixing device according to claim 8, wherein said electrode layer is formed inside said heat generating layer.

13. The fixing device according to claim 8, wherein said electrode layer is formed on an outer peripheral surface of said heat generating layer.

14. The fixing device according to claim 13, further comprising an elastic layer formed outside said electrode layer.

15. An image forming apparatus comprising:

an image forming portion for forming an image on a recording material; and a fixing portion for fixing the image on the recording material, wherein said fixing portion includes a cylindrical fixing member including a heat generating layer and an electrode layer contacting said heat generating layer, wherein said electrode layer is smaller in volume resistance value than said heat generating layer, wherein said electrode layer is formed in a helical shape so that a helical axis thereof extends in a direction along a generatrix direction of said fixing member from one end toward the other end of said electrode layer;

a coil provided at a hollow portion of said cylindrical fixing member, wherein said coil includes a helical stepped portion having a helical axis extending in a direction along the generatrix direction of said cylindrical fixing member, and forms a magnetic field for subjecting said heat generating layer to electromagnetic induction heating by causing an alternating current to flow through said coil; and a magnetic core provided inside the helical stepped portion of said coil and extending in the generatrix direction, wherein the image recording material is fixed on the recording material by heat from said cylindrical fixing member.

16. The image forming apparatus according to claim 15, wherein said electrode layer is formed so that with respect to the generatrix direction, a region between a part, of adjacent parts of said electrode layer, closest to said one end of said electrode layer and a part, of the adjacent parts of said electrode layer, closest to said the other end of said electrode layer is broader than or equal to a maximum image forming region where the image is formed on the recording material by said image forming portion.

* * * * *